US010443361B2

(12) United States Patent
Sites

(10) Patent No.: US 10,443,361 B2
(45) Date of Patent: Oct. 15, 2019

(54) MULTI-SHOT CHARGE FOR PERFORATING GUN

(71) Applicant: IdeasCo LLC, Venetia, PA (US)

(72) Inventor: Joseph Sites, Venetia, PA (US)

(73) Assignee: IdeasCo LLC, Venetia, PA (US)

( * ) Notice: Subject to any disclaimer, the term of this patent is extended or adjusted under 35 U.S.C. 154(b) by 159 days.

(21) Appl. No.: 15/470,245

(22) Filed: Mar. 27, 2017

(65) Prior Publication Data

US 2018/0274342 A1 Sep. 27, 2018

(51) Int. Cl.

| | |
|---|---|
| ***E21B 43/117*** | (2006.01) |
| ***F42B 1/02*** | (2006.01) |
| ***F42B 3/08*** | (2006.01) |
| ***F42B 3/22*** | (2006.01) |

(52) U.S. Cl.

CPC ..... *E21B 43/117* (2013.01); *F42B 1/02* (2013.01); *F42B 3/08* (2013.01); *F42B 3/22* (2013.01)

(58) Field of Classification Search

CPC ..... E21B 43/117; F42B 1/02; F42B 3/08
See application file for complete search history.

(56) References Cited

U.S. PATENT DOCUMENTS 2,494,256 A * 1/1950 Muskat ..... C10G 61/06 175/4.56
2,587,244 A 2/1952 Sweetman
2,750,884 A * 6/1956 Gaines ..... E21B 43/117 102/310
2,779,278 A * 1/1957 Klotz, Jr. ..... E21B 43/116 102/310
2,873,676 A * 2/1959 Caldwell ..... E21B 43/117 102/310
3,013,491 A * 12/1961 Poulter ..... E21B 43/117 102/309
3,100,445 A * 8/1963 Poulter ..... C06B 23/001 102/309
3,237,559 A * 3/1966 Auberlinder ..... E21B 43/117 102/306

(Continued)

OTHER PUBLICATIONS

United States Patent and Trademark Office; Office Action; Office Action from U.S. Appl. No. 15,570,190; pp. 1-12; publisher United States Patent and Trademark Office; published Alexandria, Virginia, USA; copyright and dated Nov. 20, 2017; (12 pages).

*Primary Examiner* — Giovanna C Wright
(74) *Attorney, Agent, or Firm* — Metz Lewis Brodman Must O'Keefe LLC

(57) ABSTRACT

A multi-shot explosive charge includes a plurality of chambers divided by shared walls between adjacent chambers. Explosive material within at least one of the chambers creates an explosive force in an outward direction upon detonation and a perforating jet through the open end of the chamber. A perforating charge includes at least one explosive material producing explosive forces, upon detonation that collide within the chamber to create a perforating jet. Such perforating charge may be a chamber(s) within a multi-shot explosive charge, or an individual charge. First and second explosive materials can have the same or different compositions and detonation rates that together with the arrangement of materials within the chamber create the collision of forces. A plurality of multi-shot explosive charge or stand-alone perforating charges with colliding forces can be interconnected in an array, and can be included in a perforating gun(s).

21 Claims, 20 Drawing Sheets

(56) References Cited

U.S. PATENT DOCUMENTS

| | | | | |
|---|---|---|---|---|
| 3,241,488 | A * | 3/1966 | Glass | E21B 43/117 102/310 |
| 4,753,301 | A | 6/1988 | Berry | |
| 4,800,815 | A | 1/1989 | Appledorn | |
| 5,450,794 | A | 9/1995 | Drimmer | |
| 5,619,008 | A | 4/1997 | Chawla | |
| 7,913,758 | B2 | 3/2011 | Wheller | |
| 8,904,935 | B1 | 12/2014 | Brown | |
| 9,038,713 | B1 | 5/2015 | Bell | |
| 9,145,763 | B1 | 9/2015 | Sites | |
| 9,428,979 | B2 | 8/2016 | Bell | |
| 2005/0115391 | A1* | 6/2005 | Baker | E21B 43/117 89/1.151 |
| 2005/0126420 | A1 | 6/2005 | Givens | |
| 2007/0095529 | A1* | 5/2007 | Bond | E21B 43/117 166/259 |
| 2007/0240599 | A1 | 10/2007 | Pratt | |
| 2011/0146519 | A1* | 6/2011 | Han | F42B 1/02 102/332 |
| 2013/0056269 | A1 | 3/2013 | Xu | |
| 2015/0233219 | A1 | 8/2015 | Bell | |
| 2015/0345245 | A1* | 12/2015 | Bell | E21B 43/117 102/310 |

* cited by examiner

MULTI-SHOT CHARGE FOR PERFORATING GUN

FIELD OF THE INVENTION

This invention relates to perforation of conventional and unconventional oil and gas wells and the perforation of wells that utilize hydraulic fracturing of rock formations in the production of oil and natural gas. More in particular, it relates to perforating guns and charges for use therewith to create perforation tunnels for oil and gas well production and perforation used in the hydraulic fracturing process.

BACKGROUND

Perforation of wells is a commonly utilized technique for harvesting fossil fuels such as oil and natural gas that are entrained in rock and other geological formations. Wells are drilled into the ground to a sufficient depth to penetrate the rock bed where fossil fuels are located in subterranean formations, typically about one mile or more down. The angle of the well can be turned so that further well drilling can continue parallel to the ground surface for several more feet or miles. The resulting wellbore is fitted with a casing or tubulars to prevent the well from collapsing in on itself during the remainder of the process. A perforating gun is then lowered down the wellbore, such as on a wire, to terminal end or "toe" of the wellbore. A plug at the leading edge of the perforating gun plugs the wellbore isolating each stage of hydraulic fracturing completion. Explosive charges within the perforating gun are then detonated as the perforating gun is retracted a distance up the wellbore. Detonation of the charges creates high pressure, high velocity perforation jet from each charge that blows targeted holes in the sides of the perforating gun and well tubular(s), piercing tight, controlled perforation tunnels through the tubular(s) and cement then into the surrounding rock formation. Once the well or stage is perforated, the perforating gun is fully retracted from the wellbore, proppant, a mixture of sand, water and other fluids, is then sent down the wellbore, passing through each of the perforations and into the surrounding rock. The sand and fluid create a permeable path for natural gas and oil from the rock to enter the wellbore. When all the existing perforation tunnels have been hydraulically fractured within a stage, hydraulic fracturing of that stage ends and the next stage of work begins. Another gun string consisting of a plug and multiple guns is lowered again into the wellbore, and the process of plug isolating, perforating, and fracturing begins on a new section. This process is repeated iteratively until the entire wellbore is exhausted.

Perforating guns include a plurality of charges to create the controlled explosions and quantity of perforation tunnels necessary to perforate the rock formations. However, creating explosions of sufficient force to perforate the gun housing and well casing, while simultaneously also being sufficiently directed and targeted to create a narrow tunnel in the rock formation that permits further fracturing and release of the entrained oil and natural gas without collapsing in on itself, is a feat of engineering. Accordingly, the number, placement and pattern of perforating charges within each perforating gun are critical to optimize harvesting capacity without compromising structural integrity of the tubulars. To further complicate the process, not all stages perform uniformly or provide the same amount of harvested material. Some stages or perforation clusters within a well have more or less productivity as a result of the process, and some perforations or perforation clusters become filled with the proppant faster than others. Therefore, maximizing the number of stages with the highest levels of proppant placed is one way to maximize the total productivity of a well.

There are also limits on the number of stages that can be made based on the limitations of the perforating gun. For instance, current perforating guns used in the majority of wells in the United States have an outer diameter of 2.75, 3.125 or 3.375 inches. Shaped charges each containing 15 to 25 grams of explosive are loaded in the perforating guns. Due to current design of the shaped charges and their orientation within the perforation gun, the maximum density of charges is 6 shots per foot of loaded gun. This corresponds to perforations approximately every 2 inches along the gun barrel length. Guns commonly contain 6 to 18 shots, thus corresponding to 12 to 36 inches of loaded gun barrel where perforations can occur. The shaped charges are arranged either linearly or helically in particular patterns to provide the desired number and placement of perforation tunnels. Each shaped charge, however, takes almost the full inner diameter of the perforating gun barrel to include sufficient amounts of explosive material and the other necessary components, including a metal liner, casing or housing, primer and detonation cord. The multiple shaped charges can be linked together through a common detonation cord, so that all the shaped charges can be detonated simultaneously. Typical perforating guns and shaped charges can punch holes or "perforations" of about 0.23 to 0.72 inches in diameter, and create perforation tunnels of 6 to 48 inches in length.

The size of perforating gun is also limited by the angle of the wellbore, where the wellbore transitions from the vertical direction to the horizontal direction. The perforating gun cannot be so long that it cannot navigate the turn of the well from vertical to horizontal, and cannot be so wide that it spans the entire diameter of the wellbore. In addition, once the wellbore is drilled and the casing established, it takes about 2 hours to send a perforating gun downhole in the wellbore and perforate, with another 2-3 hours to fracture the stage or zone of interest. Therefore, time and money can also play a factor in the efficiency of a wellbore.

Individual charges and shaped charges are well-known in the field of explosive charges used in perforating guns, as are carrier assemblies for loading a plurality of charges within a perforating gun. For example, U.S. Pat. No. 4,800,815 issued to Appledorn describes a carrier assembly having thin walls and a deformable opening for receiving a shaped charge when the shaped charge is inserted through the opening, and subsequently retaining the shaped charge within the opening once placed. It discloses multiple charges of a reduced size at the same lateral location within a perforation gun. However, these are individual, separate charges having separate casings, arranged to abut at their interior ends.

U.S. Pat. No. 7,913,758 to Wheller et al. and U.S. Pat. No. 8,904,935 to Brown both teach the use of multiple perforating or cutting jets arranged so the jets converge at a point. However, in each case, the convergence point is of the perforating jets and is located outside of the shaped charges generating the perforating jets. They therefore do not teach a way to maximize or increase the explosive power of the shaped charges themselves.

There is still a need in the field of well perforating to increase well production overall, such as by increasing the efficiency of well creation.

SUMMARY OF THE INVENTION

Multi-shot explosive charges, arrays, and perforating guns are disclosed that increase the number of perforation tunnels formed at a wellbore over a given lateral length of perforation gun, thus increasing the efficiency of the drilling site. The multi-shot explosive charge utilizes an entirely new design to combine a plurality of charges within a single charge casing, with each of a plurality of chambers corresponding to a traditional individual charge. The chambers are arranged within the casing such that multiple perforation tunnels can be generated through a perimetric surface of a single multi-shot explosive charge, which can all be located within the same lateral position within the wellbore.

In at least one embodiment, the new design of the multi-shot explosive charge is possible due to each of the chambers share a common wall with the next adjacent chamber. Because these walls are shared between adjacent chambers comparable perforating power despite the smaller size of the chamber and less explosive material.

In some embodiments, explosive material is positioned within the chamber(s) such that explosive forces created upon detonation converge or collide with one another inside the chamber. This may be any type of perforating charge, such as a stand-alone single chamber, individual charge, or a chamber(s) within a multi-shot charge, and can be included as part of an array and/or perforating gun. The colliding forces cooperatively generate the perforating jet. In at least one embodiment, a traditional liner is not needed since the directions of the explosive forces work together to drive the direction of the resulting perforating jet. In some of these embodiments, the explosive material may be the same, and the positioning of the material throughout the chamber influences how the forces will collide. In other embodiments, there are different types of explosive material, such as having different detonation rates or velocities. The positioning and difference in detonation rates or velocities of the various explosive materials in the chamber affects how the resulting explosive forces collide and form the perforating jet.

The multi-shot charges can be arranged in an array where a plurality of the charges are interconnected, such as for controlled detonation. In further embodiments, at least one multi-shot charge or array is included in the interior of a perforating gun, where up to 200 or more multi-shot charges can be accommodated, limited only by the size of the well and perforating gun. The larger the size of the well and/or perforating gun, either in terms of diameter or length, the greater the number of multi-shot charges that can be used in the perforating gun. Alternatively, because of the increased number of perforations possible with the multi-shot charges, the present invention also permits a smaller sized perforating gun to be used than are currently in use. Multiple perforating guns including such multi-shot charges may be strung together for delivery downhole and use.

Accordingly, the present invention minimizes the size of a perforating gun to accomplish the same number of perforations, or more. It also provides the ability to create more than one perforation and perforation tunnel at a given lateral length within a wellbore. It improves performance of perforation charges and provides more efficient perforation. Finally, it improves on perforating charges for ease of configuration and loading of a perforating gun at the wellsite.

The multi-shot explosive charges, arrays, and perforating guns, together with their particular features and advantages, will become more apparent from the following detailed description and with reference to the appended drawings.

DESCRIPTION OF THE DRAWINGS

Like reference numerals refer to like parts throughout the several views of the drawings.

DETAILED DESCRIPTION

Figure 1:
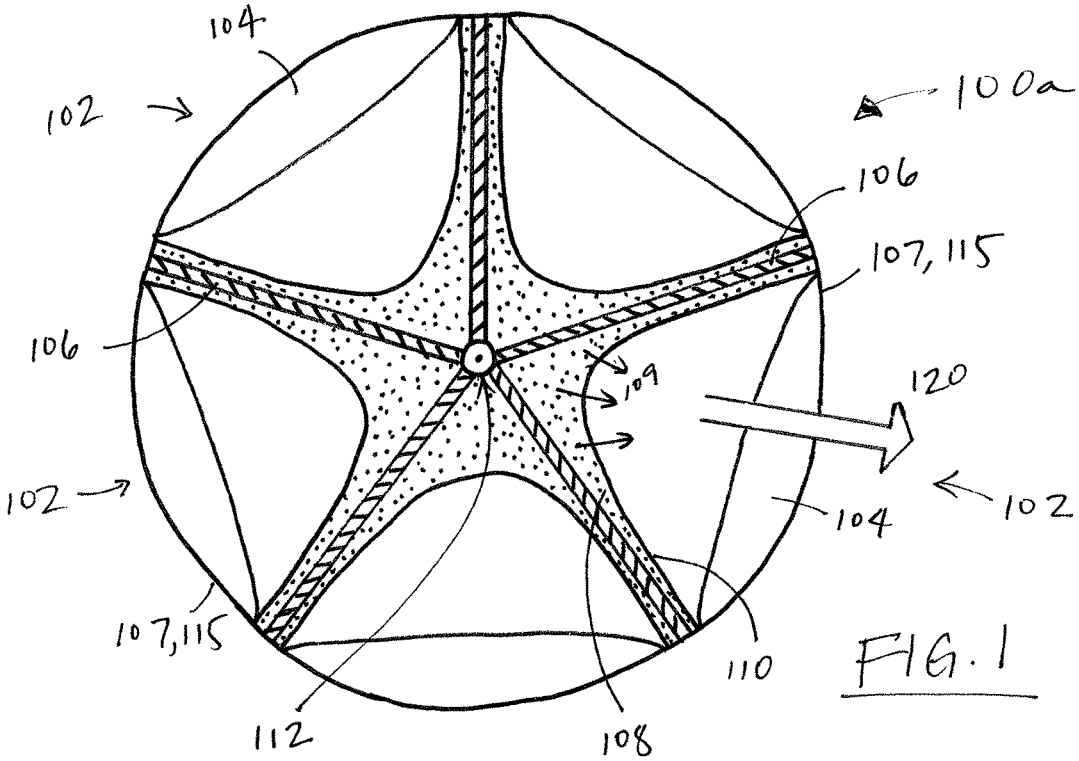
FIG. 1 is a cross-sectional top view of one embodiment of the multi-shot charge of the present invention having shared walls.

As shown in the accompanying drawings, the present invention is directed to a multi-shot charge producing a plurality of perforation tunnels at the same lateral location in surrounding strata upon detonation for harvesting entrained oil and natural gas. Specifically, as seen in FIGS. 1-4, a multi-shot charge 100 is provided which includes a plurality of chambers 102. Conventional shaped charges are single shot charges and are housed independently in individual casings. The multi-shot charge 100 as described herein, however, combines multiple shots within the same casing 107, where each chamber 102 corresponds to a separate perforating jet 120.

In at least one embodiment as seen in FIGS. 1-4, the multi-shot charge 100*a* includes at least one wall 106, or a plurality of walls 106 extending through the interior of the multi-shot charge 100*a*. The walls 106 divide the interior space of the multi-shot charge 100*a* into chambers 102, such that adjacent chambers 102 share a common wall 106. The walls 106 may be very thin, such as paper thin, measuring in the range of 1 mm to 20 mm, and may be made of the same material as the casing 107, such as steel or other metal or alloy. The walls 106 separate individual shots within the multi-shot charge 100*a*. Accordingly, the walls 106 replace part of the casing of traditional shaped perforation charges. By providing shared walls 106, the size of each shot within the multi-shot charge 100*a* can be reduced as compared to typical shaped perforating charges without sacrificing explosive power. The shared walls 106 thus enable smaller charges with equivalent or comparable explosive force and perforation tunnel creation.

Figure 5:
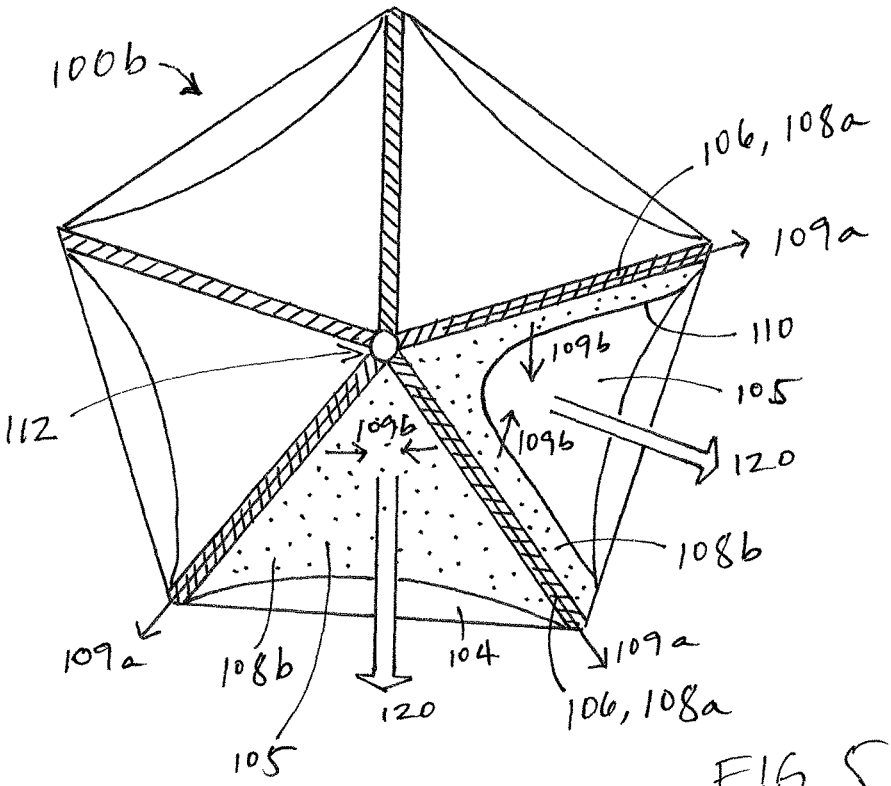
FIG. 5 is a cross-sectional top view of a second embodiment of the multi-shot charge of the present invention providing colliding forces where the shared walls include explosive material.
Figure 6:
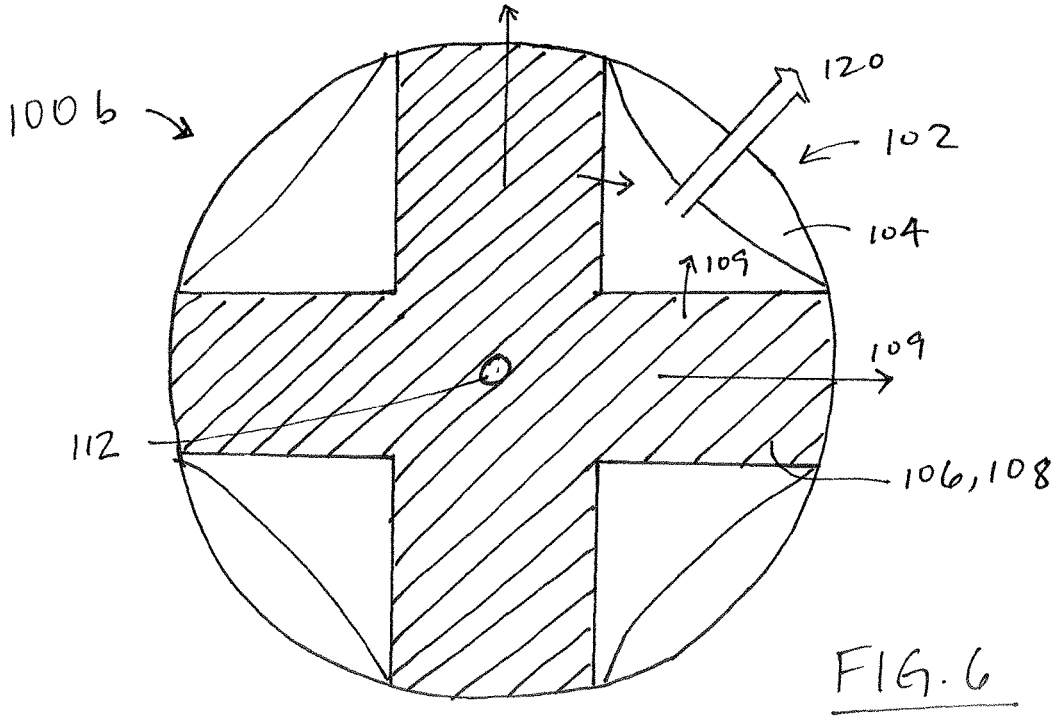
FIG. 6 is a cross-sectional top view of another embodiment of the multi-shot charge of the present invention having colliding forces where only the walls contain explosive material.
Figure 7:
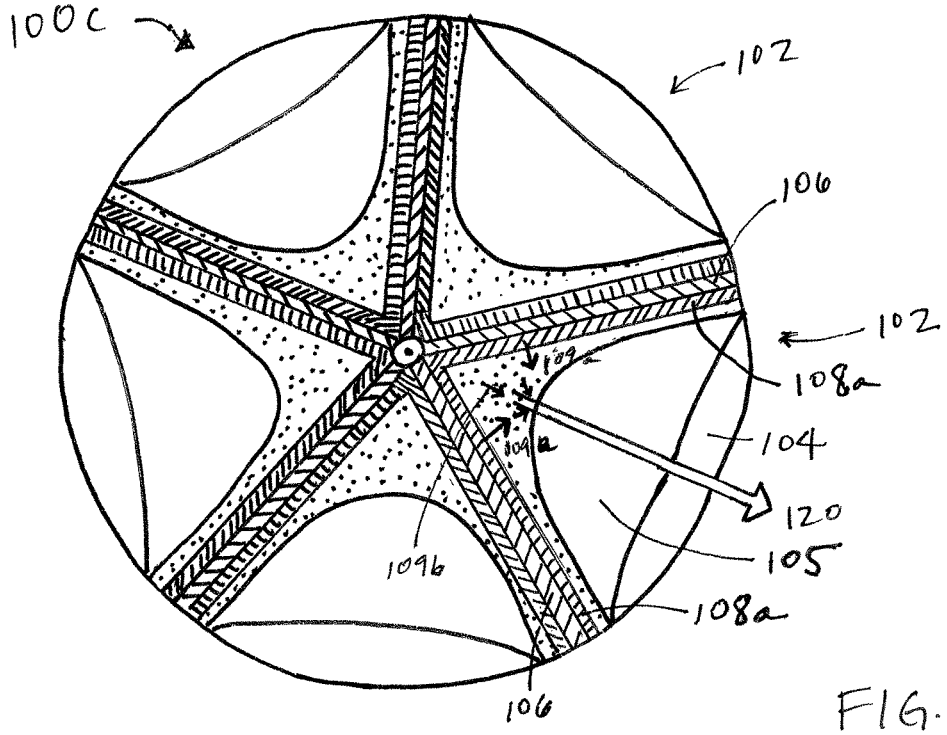
FIG. 7 is a cross-sectional top view of a different version of the multi-shot charge with colliding forces, where the shared walls are lined with explosive material, and the chamber contains additional explosive material.
Figure 8:
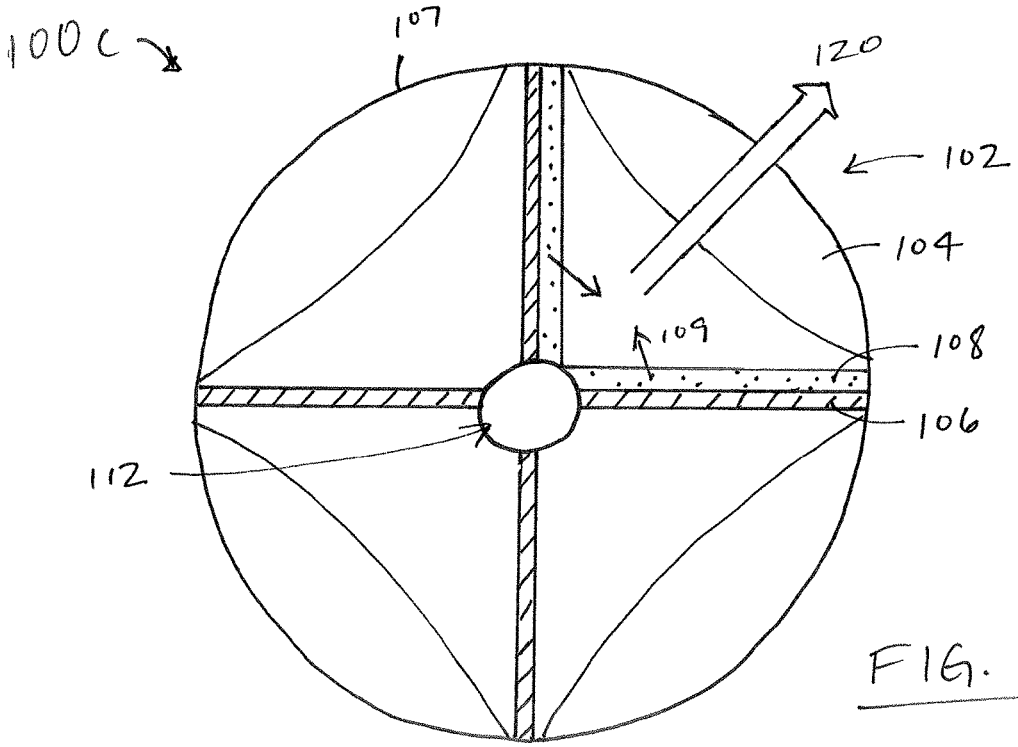
FIG. 8 is a cross-sectional top view of another embodiment of the multi-shot charge of the present invention having colliding forces where the walls are lined with explosive material.
Figure 9:
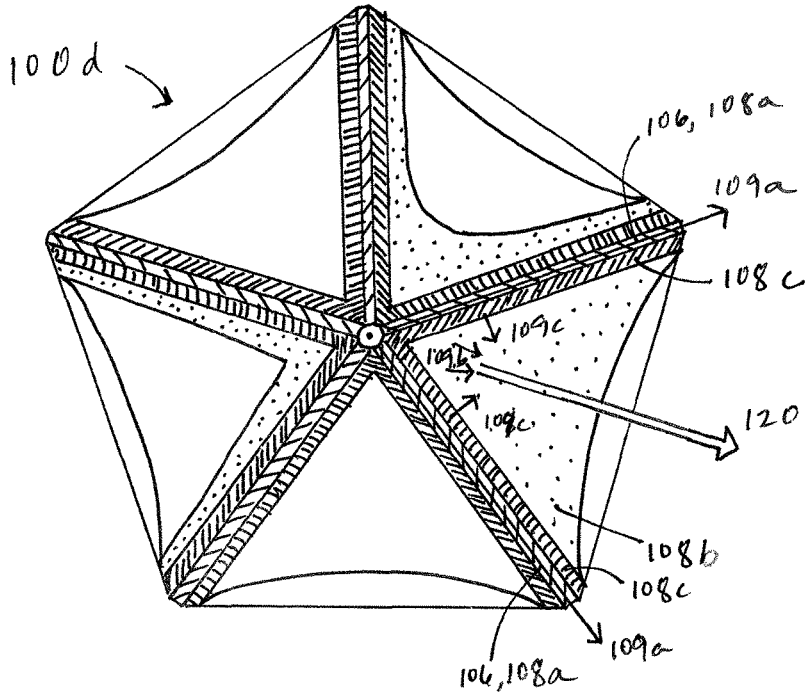
FIG. 9 is a cross-sectional top view of a different version of the multi-shot charge with colliding forces, where the shared walls include explosive material and are lined with additional explosive material, and the chamber contains additional explosive material.
Figure 10:
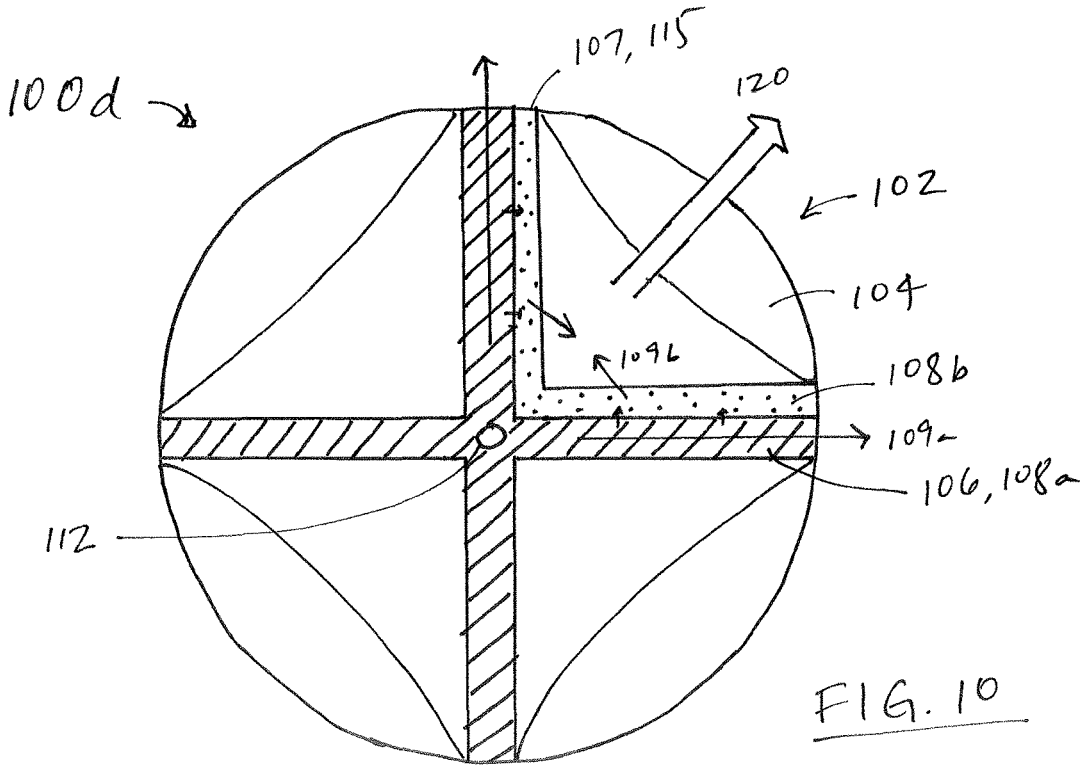
FIG. 10 is a cross-sectional top view of another embodiment of the multi-shot charge of the present invention having colliding forces where the shared walls include explosive material and are lined with additional explosive material.

The multi-shot charge 100 may include any number of chambers 102, such as from 2 to 12 chambers. For instance, in at least one embodiment, the multi-shot charge 100 may include from 3 to 8 chambers 102. In at least one embodiment, the multi-shot charge 100 may include 3 to 5 chambers 102. In other embodiments, the multi-shot charge 100 may include 6 or 8 chambers 102. For instance, in FIGS. 1 and 4, the multi-shot charge 100*a* includes 5 chambers 102, whereas in FIG. 2 the multi-shot charge 100*a* includes 3 chambers 102, and in FIG. 3 the multi-shot charge 100*a* includes 12 chambers 102. In other embodiments as shown in FIGS. 5, 7 and 9 and discussed in greater detail hereinafter, the multi-shot charge 100*b,c,d* includes 5 chambers 102. In the embodiments of FIGS. 6, 8 and 10 discussed later, the multi-shot charge 100*b,c,d* includes 4 chambers 102. In some embodiments, a symmetrical distribution of chambers 102 within the casing 107 may be preferred, such as to provide balance in the event of detonation. Any number of chambers 102 may be formed in the multi-shot charge 100 as desired and permitted by at least the size and dimensions of the multi-shot charge 100 and the parameters of the desired perforation. Further, the chambers 102 may be identical to one another, or may have different sizes or angles between adjacent walls 106.

In the embodiments of FIGS. 1-4, each chamber 102 of the multi-shot charge 100*a* is defined by an opening 104 at the perimeter of the casing 107 and at least one, but preferably two walls 106 extending between the top and bottom of the casing 107, and extending from the center to the perimeter, or perimetric surface 115, of the casing 107. The walls 106 may extend from a central portion of the multi-shot charge 100, such as a channel 103, thus dividing the space into radially adjacent wedge-shaped chambers. Accordingly, in some embodiments as in FIGS. 1-4, the casing 107 may have a circular or disc shape. In other embodiments, however, the casing 107 may be a square, rectangular, linear, oblong, or irregular shape. The chambers 102 may therefore be arranged linearly, irregularly, or in no particular order or pattern within the casing 107. Regardless of the shape of the casing 107 and the disposition of the chambers 102 therein, the casing 107 includes a perimetric surface 115 and each chamber 102 includes a corresponding opening 104 at the perimetric surface 115.

Figure 2:
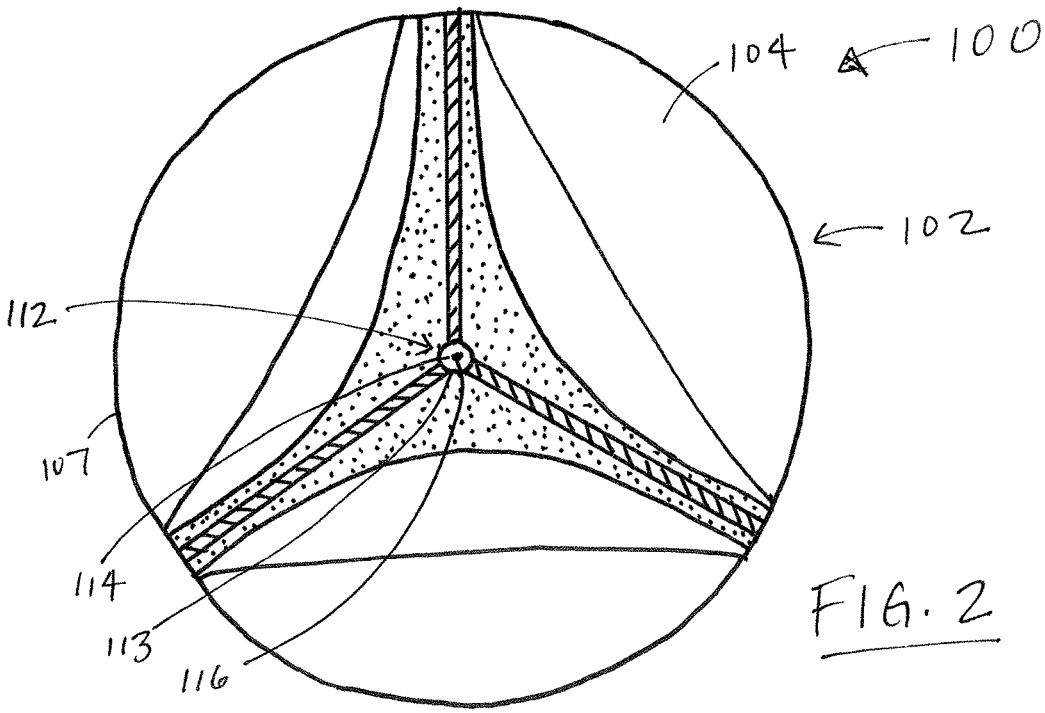
FIG. 2 is a cross-sectional top view of a different version of the multi-shot charge of the present invention having 3 chambers and a curved casing.

A detonation assembly 112, which may include a primer 114, detonation cord 116 or other device capable of initiating or transmitting detonation, may be located at the channel 103 or center of the multi-shot charge 100 in contacting or detonating proximity to explosive material of the chambers 102, such as illustrated in FIG. 2. The detonation assembly 112 is positioned opposite of the opening 104 of each chamber 102, such that the explosive force resulting from the detonation forces the material out of the chamber 102 through the opening 104 in a perforating jet 120. The primer 114 may be a blasting cap, lead azide, or other highly sensitive high explosive, or any material suitable for initiating detonation of explosive material. Amounts of 1 milligram to 20 grams of primer 114 may be utilized, and may be included at the center of the multi-shot charge 100 as a sphere, disc, cylinder, or other shape. Enough primer 114 is used to provide detonation to each of the chambers 102, such as by contacting or abutting at least a portion of each chamber 102, such as the inner tip. In some embodiments, a detonation cord 116 may also be included in the detonation assembly 112. The detonation cord 116 contacts the primer 114, extending through the primer 114 and multi-shot charge 100 in some embodiments, and may further extend away from the multi-shot charge 100, such as up the well for remote detonation. The end of the detonation cord 116 may be ignited, and the spark moving along the length of the detonation cord 116 until it reaches the primer 114 or other detonation assembly 112 in the multi-shot charge 100 located in the well. Thus, the detonation cord 116 provides one method of remote detonation of the multi-shot charge 100.

At least one chamber 102 may also include an amount of explosive material 108, such as is commonly used in perforating charges. For example, the explosive material 108 may be any of RDX (also known as cyclotrimethylene trinitramine, cylocnite, hexogen or T4), HMX (also known as cyclotetramethylene trinitramine, octogen, tetrahexamine tetranitramine, or octahydro-1,3,5,7-tetranitro-1,3,5,7-tetrazocine), HNS (also known as hexanitrostilbene or JD-X), lead azide, PETN (also known as PENT, pentaerythritol tetranitrate, and pentrite), nitramides, nitroamines, octols, plastic explosive, or other suitable explosive material that can be used primarily as a explosive agent or to ignite/detonate another explosive material. The explosive material 108 may be pure or a combination or mixture of ingredients, such as but not limited to the explosive materials listed above, other energetic components, polymers, waxes, binders, metals, metal alloys, and other inert components. The explosive material 108 is preferably castable, but may also be granular, solid, or semi-solid, and may be formed by any appropriate method.

The explosive material 108 is selectively inserted into desired chambers 102 and in particular arrangements to charge the chamber. For instance, in at least one embodiment, as in FIG. 1, the explosive material 108 may be packed into a portion of the chamber(s) 102 so that at least a portion of the explosive material 108 is in detonating proximity to the detonation assembly 112 such that the explosive material 108 is sufficiently close to the detonation assembly 112 to be ignited by detonation of the detonation assembly 112.

Figure 3:
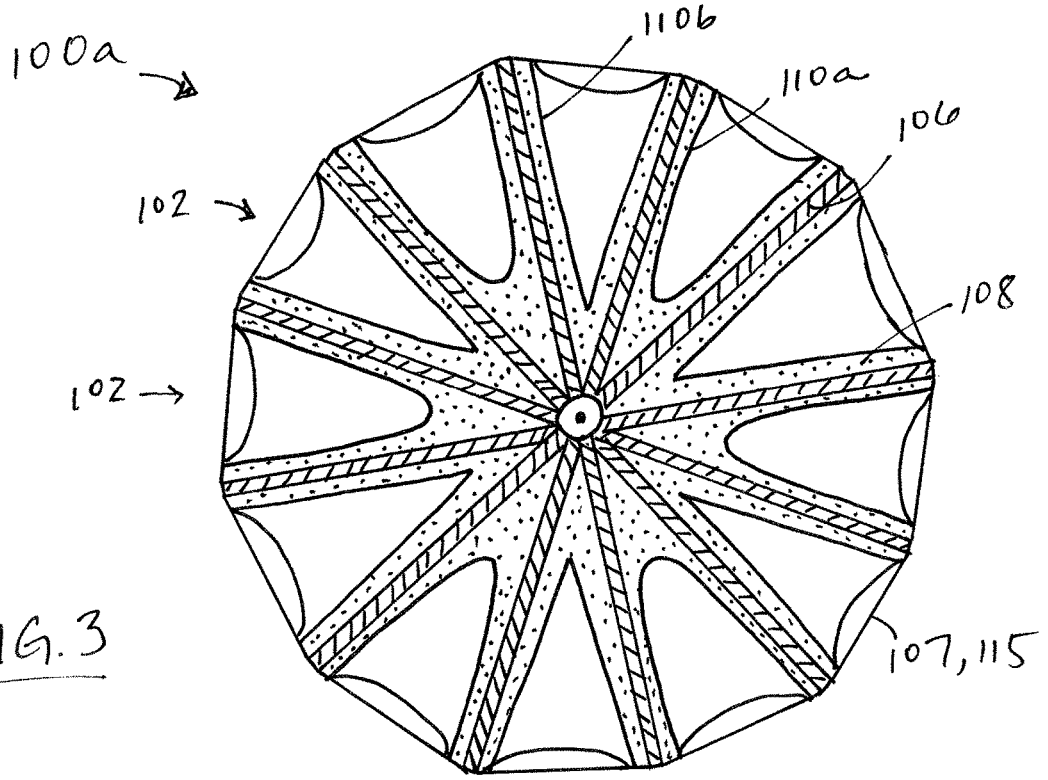
FIG. 3 is a cross-sectional top view of a different version of the multi-shot charge of the present invention, having 12 chambers and a straight walled casing.

In at least one embodiment, as shown in FIGS. 1-4, the chamber 102 may include a liner 110 to retain and shape the explosive material 108 within the chamber 102 and near the detonation assembly 112. The liner 110 also directs the explosive force 109 resulting from the detonation of the explosive material 108 into a perforating jet 120 that pierces the casing 107 and wellbore tubulars to form a perforation tunnel. The liner 110 may be any suitable liner material commonly used in shaped charges, such as but not limited to aluminum, copper, titanium, and other metals, metal alloys, and high-density, highly ductile materials. The liner 110 may be composed of a single material, or may be a combination of materials mixed or combined. In some embodiments, the liner 110 may include various layers, such as of different metals such as zinc and copper, or aluminum and copper. Layers may be bonded, or melted together or otherwise affixed. In still other embodiments, the liner 110 may be made of a powdered metal(s), which may be pressed, melted, sintered or unsintered, or otherwise formed by methods of powder metallurgy. The liner 110 may be conical in shape, having an internal apex ranging from 30° to 90°. The apex of the liner 110 may be curved or angular, as shown in FIG. 3, depending on the desired parameters of the perforation jet 120 to be achieved. For instance, a curved liner 110*a* will produce a slightly wider perforation jet, and therefore broader diameter perforation. An angled liner 110*b* will produce a narrower perforation.

Figure 4:
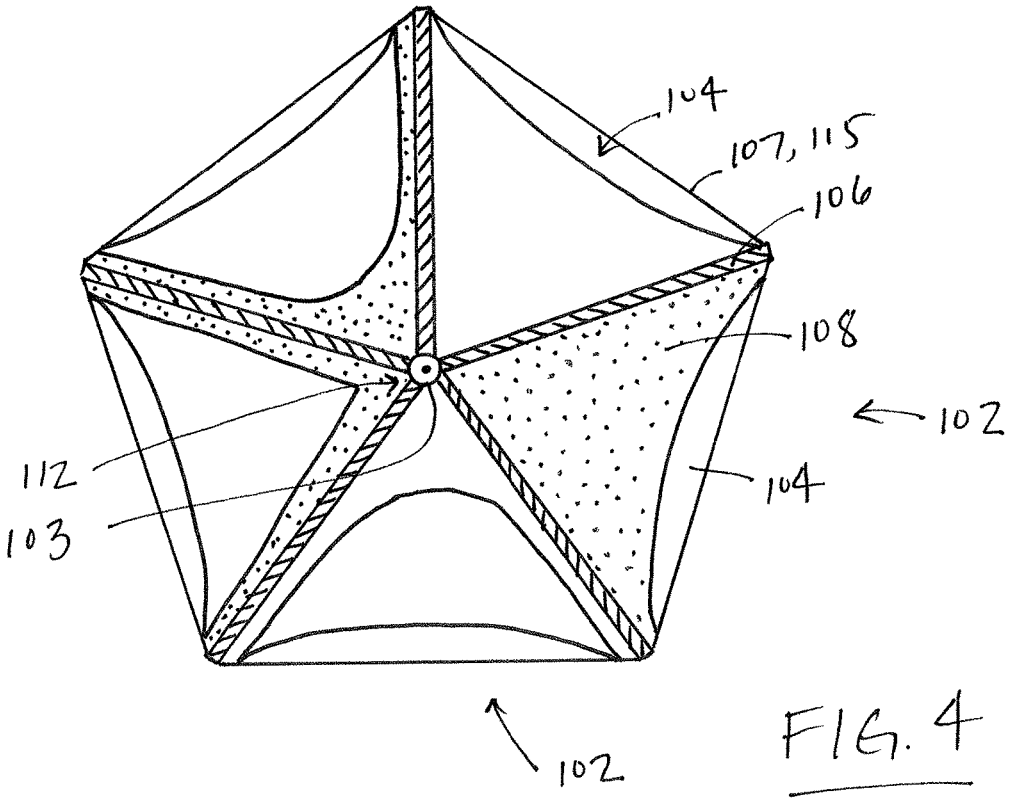
FIG. 4 is a cross-sectional top view of another version of the multi-shot charge of the present invention, having a variety of charged and empty chambers.

As depicted in FIG. 4, the chamber 102 need not have a liner 110. In such instances, the explosive material 108 may be packed or formed into the chamber 102 to fill the chamber 102 up to the opening 104. Such an arrangement may be useful when the desired perforation tunnel is shallow or minimal debris would be desired from the perforation charge or liner. Further, not every chamber 102 need include explosive material 108. As shown in FIG. 4, some of the chambers 102 may be left empty, or uncharged. Only those chambers 102 that include explosive material 108 will create perforations upon detonation. It may be desired to produce less than the full potential number of perforations at a lateral location within the strata, such as reduce stress on the wellbore. It may also be desired to create a particular pattern of perforations, which may require less than all of the chambers to be charged for detonation. Accordingly, in some embodiments, as in FIG. 4, the multi-shot charge 100 may have at least one chamber 102 containing explosive material 108, and at least one chamber 102 lacking explosive material. Any combination of chambers 102 may include explosive material 108. For example, explosive material 108 may be placed in adjacent chambers 102 that share a common wall 106, in alternating chambers 102, or in any pattern of chambers 102 as may be desired to achieve the contemplated or intended design of perforations, up to and including all the chambers 102, as in FIGS. 1-3.

Depending on the size of the multi-shot charge 100 and number of chambers 102, each chamber 102 can hold 1 to 200 grams of explosive material 108. By comparison, current traditional shaped charges hold between 3 to 60 grams of explosives. For instance, chambers 102 within a multi-shot charge 100 may be are smaller in size that standard traditional shaped charges because many chambers 102 are provided within a similar diameter as a standard traditional shaped charge. Because of this reduced size, the chambers 102 of a multi-shot charge 100 may hold less explosive material 108 than a standard individual charge, and yet have comparable perforating power. On the other hand, chambers 102 of a multi-shot charge 100 of the present invention can also be filled to the opening 104 with explosive material 108, such that no liner 110 is needed. Indeed, the entire interior of the chamber 102 can be filled with explosive material 108. Therefore, the chambers 102 of a multi-shot charge 100 may hold more explosive material 108 than a standard individual charge, and may provide increased perforating power.

In some embodiments, as depicted in FIGS. 5-17, the explosive material 108 is arranged to create converging or colliding explosive forces 109 within a chamber(s) 102 of a perforating charge, which can be a chamber(s) 102 within a multi-shot charge 100 or the chamber of a single charge 101. This directs and augments the explosive forces 109 created in the charge, further maximizing explosive potential within a smaller sized charge. For instance, a charged chamber 102, includes at least one explosive material 108 that is capable of producing at least one explosive force 109 upon detonation. Opposing explosive forces 109 directed at one another from different sides of the chamber 102 collide within the chamber 102 to create a resulting perforating jet 120 that is directed toward the open end or opening 104 of the chamber 102. The angle of the perforating jet 120 is a result of the combination of the colliding forces 109 that create the perforating jet 120. In some embodiments, the perforating jet 120 is transverse or substantially perpendicular to the colliding explosive forces 109, such as when the colliding explosive forces 109 collide at 180° relative to one another in a head-on manner. In other embodiments, the explosive forces 109 collide at an angle less than 180° relative to one another, such that the resulting perforating jet 120 is at an obtuse angle relative to the colliding explosive forces 109.

In certain embodiments, the chamber 102 may include a first explosive material 108*a* that produces a first explosive force 109*a* upon detonation, and a second explosive material 108*b* that produces a second explosive force 109*b* upon detonation. The first and second explosive materials 108*a,b* may have the same composition, which may be a single material or a mixture of materials. The first and second explosive materials 108*a,b* may be arranged in the chamber 102 in different places, such as separated along a wall 106 or the edge of the chamber 102. In other embodiments, the first and second explosive materials 108*a,b* have different compositions, which may be single materials or mixtures of materials. The first and second explosive forces 109*a,b* converge or collide within the chamber 102 to produce the perforating jet 120 in an outward direction that exits the chamber 102 through the opening 104 in the perimetric surface 115. The explosive material 108 arrangements, explosive forces 109 and resulting perforating jets 120 formed by the collision of forces 109 within the chamber 102 are possible within any chamber of the multi-shot charge 100 of the present invention, demonstrated in FIGS. 5-10, as well as in a traditional individual charge 101, depicted in FIGS. 11-17.

FIG. 5 provides an illustrative example of one example of a multi-shot charge 100*b* where the walls 106 between adjacent chambers 102 include a first explosive material 108*a*, and the chamber 102, if charged, includes a second explosive material 108*b*. In some embodiments, the walls 106 may be impregnated with the first explosive material 108*a*. In other embodiments, the walls 106 may be at least partially filled with the first explosive material 108*a*, such as if the walls 106 are formed with a channel, pockets, or other void spaces within the walls 106 separating adjacent chambers 102. These channel(s), pocket(s), or other void spaces in the walls 106 may be at least partially filled with the first explosive material 108*a*. In still other embodiments, the walls 106 may be formed at least partially or entirely of first explosive material 108*a*. For instance, the walls 106 may be made of a mixture or composite of aluminum, steel, or other metal typically used in the casing of the charge, as well as the first explosive material 108*a* in sufficient quantities to cause detonation of the wall at the rate of the first explosive material 108*a*. Plasticizers, binders, and other additives may also be included. In some embodiments, the walls 106 may be made entirely of first explosive material 108*a*. The second explosive material 108*b* is located within the chamber 102, such as packed into the interior 105 of the chamber 102. The second explosive material 108*b* may be retained within the chamber 102 by a liner 110. However, a liner 110 is not necessary, as the second explosive material 108*b* may also fill the entire interior space of the chamber 102 up to the opening 104.

Each of the first and second explosive materials 108*a,b* may be any of the explosive materials described previously. Further, the first and second explosive materials 108*a,b* may be the same material or composition of materials, or different materials or compositions of materials with different properties. For instance, the first and second explosive materials 108*a,b* may have different or non-identical sensitivities to shock. As used herein, "different" and "non-identical" are used interchangeably to indicate any level or degree of difference. The difference may be slight, even by fractions of a unit measurement. For instance, the first explosive material 108*a* may be more sensitive to shock for detonation than the second explosive material 108*b*. Examples of such materials include those that are used in primers 114, such as lead azide or PETN. In these embodiments, the first explosive material 108*a* is detonated by the detonation assembly 112, and the pressure wave from the first explosive material 108*a* propagates into and is in turn detonates the second explosive material 108*b*, which may be less sensitive to shock for detonation. Examples of such material include RDX, HMX, and HNS. These are non-limiting examples used for illustrative purposes only. The types of explosive materials discussed previously have known sensitivities to shock. In some embodiments, it may be beneficial or preferable for the first explosive material 108*a* within the walls 106 to be more sensitive to shock than the second explosive material 108*b* within the chamber 102, so that the first explosive material 108*a* detonates first and, in turn, detonates the second explosive material 108*b*. This ordering of successive detonations occurring from the walls 106 toward the interior 105 of the chamber 102 assists in directing explosive forces 109*a,b* toward the interior 105 of the chamber 102 for collision within the chamber 102. However, in other embodiments, the first and second explosive materials 108*a,b* may have the same sensitivity to detonation and may detonate at the same time. In other examples, the second explosive material 108*b* may be more sensitive to shock for detonation than the first explosive material 108*a*. However, in other embodiments the first and second explosive materials 108*a,b* can have identical sensitivities to shock for detonation.

The first and second explosive materials 108*a,b* may have different or non-identical detonation rate or velocity. As used herein, "detonation rate" and "detonation velocity" may be used interchangeably to refer to the speed at which the explosive material detonates, which can encompass ignition, burn, pressure wave creation and propagation. The various explosive materials discussed previously have known detonation rates. In at least one embodiment, the first explosive material 108*a* has a faster detonation rate than the second explosive material 108*b*, even if only by fractions of a unit measure. For example, the first explosive material 108*a* could have a detonation rate of 6,400 m/s, and about the second explosive material have a detonation rate of 6,399 m/s or 6,399.99 m/s. In another example, the first explosive material 108*a* may be HMX with a detonation velocity of 9,400 m/s while the second explosive material 108*b* is PETN with a detonation velocity of 8,400 m/s. The explosive material in 108*a* and 108*b* may be chosen. In other embodiments, the first explosive material 108*a* has a slower detonation rate than the second explosive material 108*b*, even if only incrementally slower. However, in other embodiments the first and second explosive materials 108*a,b* can have identical detonation rates.

The particular materials of the first and second explosive materials 108*a,b* may be chosen based on a desired specific pressure wave effect, or explosive force 109, and desired perforation tunnel. For instance, the difference in detonation rates between the first and second explosive materials 108*a,b* will affect the diameter of the perforation jet and the length of the resulting perforation tunnel. For instance, the larger the difference of detonation rates between the first and second explosive materials 108*a,b*, particularly when the faster material is located at the walls 106 of the chamber 102 and the slower material is located more to the interior 105 of the chamber 102, the more the explosive forces 109*a,b* will push in toward the interior 105 of the chamber 102, and the smaller the diameter or width of the resulting perforating jet 120 will be. The more similar the detonation rates of the first and second explosive materials 108*a,b*, the explosive forces 109*a,b* will propagate at more similar rates, and the wider the diameter of the resulting perforating jet 120. Also, wider perforating jets 120 tend to produce more shallow perforation tunnels. The narrower or smaller the diameter of the perforating jet 120, the longer or deeper the perforation tunnel is. Accordingly, the particular explosive material(s) used depend on the length and diameter of the desired tunnel.

The magnitude of the explosive forces 109*a,b* may also affect the perforating jet 120, and therefore the size and shape of the perforation tunnel. For instance, stronger explosive forces 109*a,b* having greater magnitudes produce longer perforation tunnels, since they provide more pressure. Similarly, stronger explosive forces 109*a,b* will produce collisions of greater magnitude force, which can also result in longer perforation tunnels. The inverse is also true, wherein weaker explosive forces 109*a,b* produce less intense collisions and shorter perforation tunnels.

Similarly, the angle of the chamber 102 will also impact the size and shape of the perforating jet 120 and tunnel. The wider the angle of the walls 106 of the chamber 102, the wider the diameter of the perforating jet 120 and the shallower the tunnel. The narrower the angle of the walls 106 of the chamber 102, the narrower the diameter of the perforating jet 120 and the longer the tunnel will be. Since the angle of the walls 106 decreases as the number of chambers 102 within a multi-shot charge 100 increases, the number of chambers 102 will also affect the size and shape of the perforating jet 120 and tunnel.

The multi-shot charge 100*b* is detonated by the detonation assembly 112, which may preferably be located at the center of the multi-shot charge 100, but may be located anywhere therein. The detonation assembly 112 may include primer 114 and/or detonator cord 116. Ignition of the detonation assembly 112 causes the explosive material(s) 108 to detonate. In at least one embodiment, as shown in FIG. 5 where the walls include a first explosive material 108*a* having a faster detonation rate than the second explosive material 108*b*, detonation of the detonation assembly 112 causes the first explosive material 108*a* in the walls to detonate, creating a first explosive force 109*a*. This first explosive force 109*a*, such as a pressure wave, travels up the wall 106 in an outward direction as indicated in FIG. 5. Each wall 106 having first explosive material 108*a* detonates simultaneously, creating first explosive forces 109*a* radiating outwardly from the detonation assembly 112. The first explosive material 108*a* and/or the detonation assembly 112 detonates the second explosive material 108*b*. When the second explosive material 108*b* is detonated, it creates at least one second explosive force 109*b*, such as a pressure wave, in the direction indicated in FIG. 5, generally away from the walls 106 and inward toward the interior of the chamber 102. Second explosive forces 109*b* from opposite walls 106 are therefore traveling toward each other and converge or collide in the interior 105 of the chamber 102, causing an intense resultant force.

The colliding explosive forces 109*b* may converge or collide at any angle within the interior 105 of the chamber 102. As used herein, the terms "converge" and "collide" are used interchangeably to mean coming together in an impact. For instance, in at least one embodiment, the colliding explosive forces 109*b* are directly opposing one another and collide at 180° in a head-on orientation. This may occur when the first explosive material 108*a* detonates almost instantaneously. In other embodiments, the colliding explosive forces 109*b* are directed at one another, but may be slightly angled toward the opening 104 of the chamber 102 as well, so that the angle of collision is a right angle or even acute angle. This may occur when the first explosive material 108*a* detonates more slowly, but still at a faster rate than the second explosive material 108*b*. Regardless of the angle of impact or collision, the colliding explosive forces 109*b* impact one another within the interior of the chamber 102, creating a resultant force transverse to the path of the explosive forces 109*b* prior to impact.

The resultant force from colliding explosive forces 109*b* is reminiscent of the force formed in colliding tools used to cut pipes from within, where opposite exploding forces from the top and bottom of the pipe or tool collide head on, resulting in a perpendicular force that severs the pipe at the lateral point of collision. However, such colliding forces have not been used in charges within perforating guns before. This resultant force from the collision of the converging or colliding explosive forces 109*b* becomes the perforating jet 120 that exits the opening 104 of the chamber 102 and pierces the perforating gun, wellbore tubulars, and ultimately geographical strata surrounding the wellbore. Each chamber 102 that is charged with explosive material will create a perforating jet 120 upon detonation.

The timing of the detonation of explosive materials 108*a,b* directs to movement of the explosive forces 109*a,b*. Therefore, in at least one embodiment, a liner 110 is not needed in the chambers 102. Liners 110 are typically used to retain the explosive material within the charge, but also to shape the explosive material to direct the explosive force to form a perforating jet. In the present invention, such as at FIG. 5, the explosive force 109*b* of the second explosive material 108*b* is directed to the interior of the chamber 102 by the explosive force 109*a* of the first explosive material 108*a*. The perforating jet 120 is formed when opposite second explosive forces 109*b* collide within the chamber 102. Accordingly, a liner 110 is not needed to direct the explosive force for perforating jet formation, and the second explosive material 108*b* may be packed into the chamber 102 up to opening 104 if desired, as shown in FIG. 5. However, in some embodiments, shown in another chamber of FIG. 5, a liner 110 may be used, such as to retain the second explosive material 108*b* within the chamber 102. As before, the liner may be a curved liner 110*a*, an angled liner 110*b*, or other shape. Also, not every chamber 102 need be charged with explosive in this embodiment, as is evident from FIG. 5.

In some embodiments, as in FIG. 6, only one explosive material 108 is used, and may be included in the walls 106, such that when detonated, the explosive forces 109 collide in the chamber 102 to form a perforating jet 120. FIG. 6 depicts very thick walls 106 providing a large amount of explosive material 108. Accordingly, the walls 106 may comprise almost the entire the chamber 102. In other embodiments, however, thinner walls 106 are contemplated that still provide a sufficient amount of explosive material 108 for perforating.

In other embodiments of the multi-shot charge 100*c*, as in FIG. 7, the walls 106 may be lined with the first explosive material 108*a*, rather than being made of or encompassing the explosive. For instance, the walls 106 may be sprayed, coated, dipped, packed against, or otherwise affixed to or contacting the surfaces of the walls 106 that face the interiors of the chambers 102. In these embodiments, the walls 106 are made as usual, such as of the same material as the casing of the multi-shot charge 100*c*, and may be the same thickness as described above in other embodiments. As before, a second explosive material 108*b* may be packed into the interior 105 of the chamber 102, up to a liner 110 or the opening 104 of the chamber 102. In these embodiments, when the detonation assembly 112 is ignited, the first explosive material 108*a* lining the walls 106 detonates as explained above, causing the second explosive material 108*b* to detonate. The only difference is that the walls 106 themselves do not include the first explosive material 108*a* in these embodiments. In some embodiments, as in FIG. 8, only one explosive material 108 is used and lines the walls 106 of the chamber 102. The resulting explosive forces 109 collide within the chamber 102 and cause a perforating jet. The explosive material 108 is detonated by the detonation assembly 112 as before, and the detonation assembly 112 may be any size or shape and in any placement in the multi-shot charge to permit detonation of the explosive material 108.

In still further embodiments, as in FIG. 9, the walls 106 may include a first explosive material 108*a* and the interior of the chamber 102 may be charged a second explosive material 108*b*, as before. In these embodiments, however, a supplemental explosive material 108*c* may also be included which lines the walls 106, and therefore lies between the first and second explosive materials 108*a,b*. This supplemental explosive material 108*c* may be any of the explosive materials previously identified, and may have a detonation time or sensitivity to shock for detonation that is greater than, less than, or intermediate between those of the first and second explosive materials 108*a,b*. The supplemental explosive material 108*c* may be applied to the walls 106 as described above with respect to lining the walls 106. Detonation of the supplemental explosive material 108*c* produces a corresponding supplemental explosive force 109*c*. The supplemental explosive material 108*c* may assist in creating particularly narrow perforating jets 120 of a small diameter, such as 0 to 25 mm, or otherwise shape the parameters of the perforating jet 120. As with the previously discussed embodiments, not all the chambers 102 need include supplemental explosive material 108*c*, or second explosive material 108*b*. In still another embodiment, as in FIG. 10, the walls 106 may include a first explosive material 108*a* and may further be lined with a second explosive material 108*b*, but no additional explosive material is packed into the chamber 102.

Figure 11:
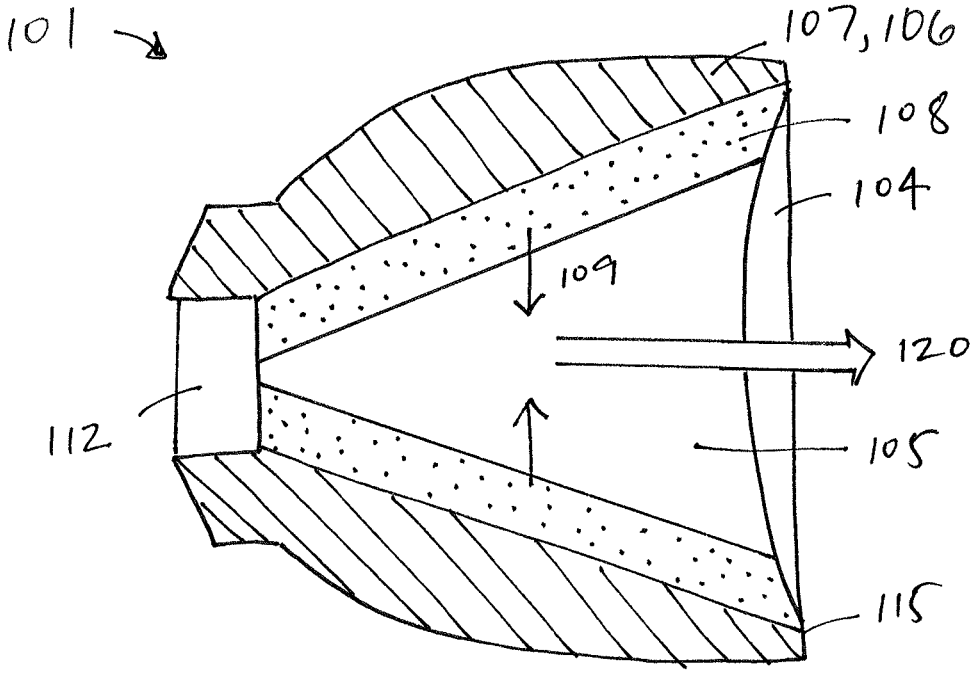
FIG. 11 is a cross-sectional view of one example of an individual charge having colliding forces, where the walls are lined with explosive material.

The colliding forces 109 may be formed in a single chamber 102 of a multi-shot charge 100, or can be formed in an individual charge 101, as depicted in FIGS. 11-17. The types of explosive material 108 and arrangements thereof can be done in individual charges 101 as well, which can have corresponding parts. For instance, FIG. 11 shows a single chamber 102 with converging or colliding forces 109 of embodiments of the present invention. The chamber 102 may include at least one wall 106 which may also be the casing 107 of the charge, and may form a continuous wall around the chamber 102. The chamber 102 may also be defined by a plurality of walls 106 that together make up the casing 107. The charge casing 107 may have any shape or configuration as permits perforation. A detonation assembly 112 is located opposite of an opening 104 in the perimetric surface 115 of the charge 101. At least one explosive material 108 is present in the chamber 102, such as affixed to or contacting the wall(s) 106 of the chamber 102. The detonation assembly 112, when detonated, would in turn detonate the explosive material 108, causing explosive forces 109 to radiate outwardly from the detonation, including toward the interior 105 of the chamber 102. As described above, as the explosive forces 109 from opposing walls 106 or different positions of the same continuous wall 106 collide, they produce a perforating jet 120 transverse to the direction of the explosive forces 109. FIG. 11 therefore depicts an example of how a single individual charge 101 can be utilized with the colliding explosive forces 109 of the present invention, similar to the configuration used in the multi-shot charge 100 shown in FIG. 8.

Figure 12:
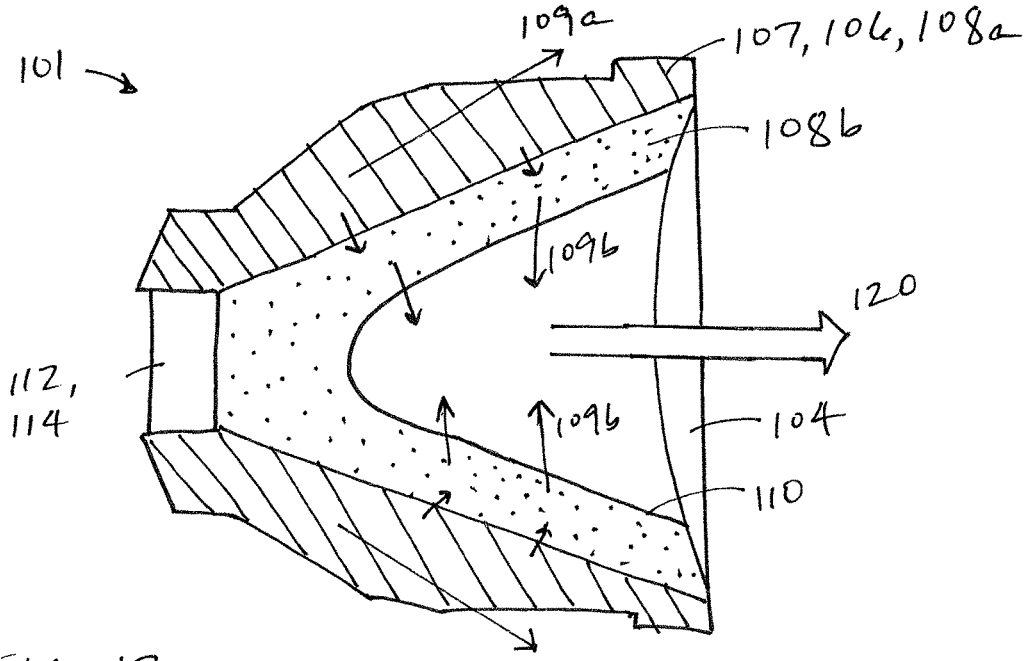
FIG. 12 is a cross-sectional view of another embodiment of an individual charge having colliding forces, where the walls of the casing include explosive material, and the chamber includes additional explosive material retained by a liner.
Figure 13:
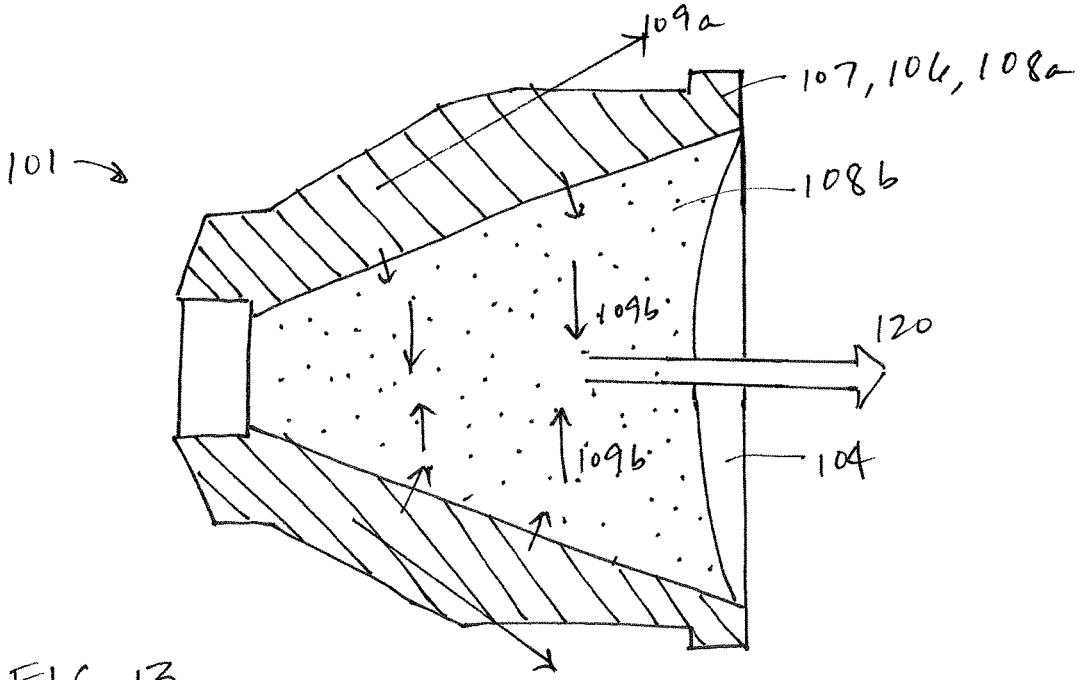
FIG. 13 is a cross-sectional view of another embodiment of an individual charge having colliding forces, where the walls of the casing include explosive material, and the chamber includes additional explosive material.

FIGS. 12 and 13 show another embodiment of an individual charge 101 utilizing the colliding forces 109 of the present invention similar to that shown in the multi-shot charge 100*b* of FIG. 5, where the walls 106 include a first explosive material 108*a* producing a first explosive force 109*a*, and a second explosive material 108*b* producing a second explosive force 109*b* is located within the interior of the chamber 102. FIG. 12 demonstrates the use of a liner 110 to retain the second explosive material 109*b*, whereas FIG. 13 shows no liner 110 and the second explosive material 109*b* filling the chamber 102 to the opening 104. As described above in relation to FIG. 5, the explosive forces 109*a,b* are generated upon detonation and are angled toward the interior of the chamber 102. When they collide within the chamber 102, they form a transverse perforating jet 120 directed toward the opening 104. FIGS. 12 and 13 also demonstrate that the casing 107 for the individual charge 101 may have any shape or configuration.

Figure 14:
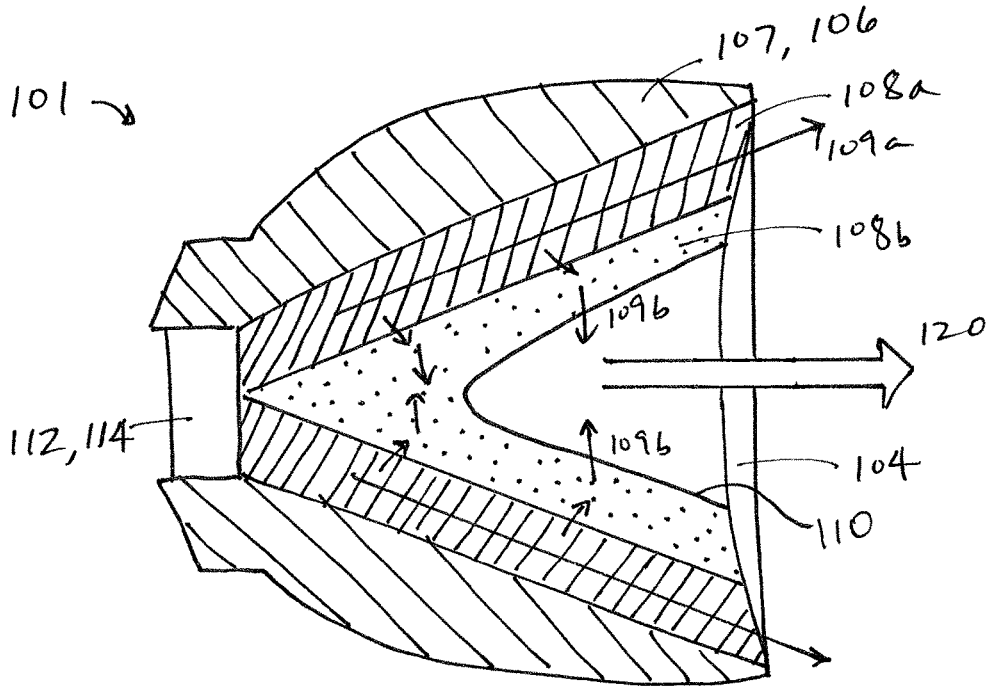
FIG. 14 is a cross-sectional view of another embodiment of an individual charge having colliding forces, where the walls of the casing are lined with explosive material and the chamber includes additional explosive material retained by a liner.
Figure 15:
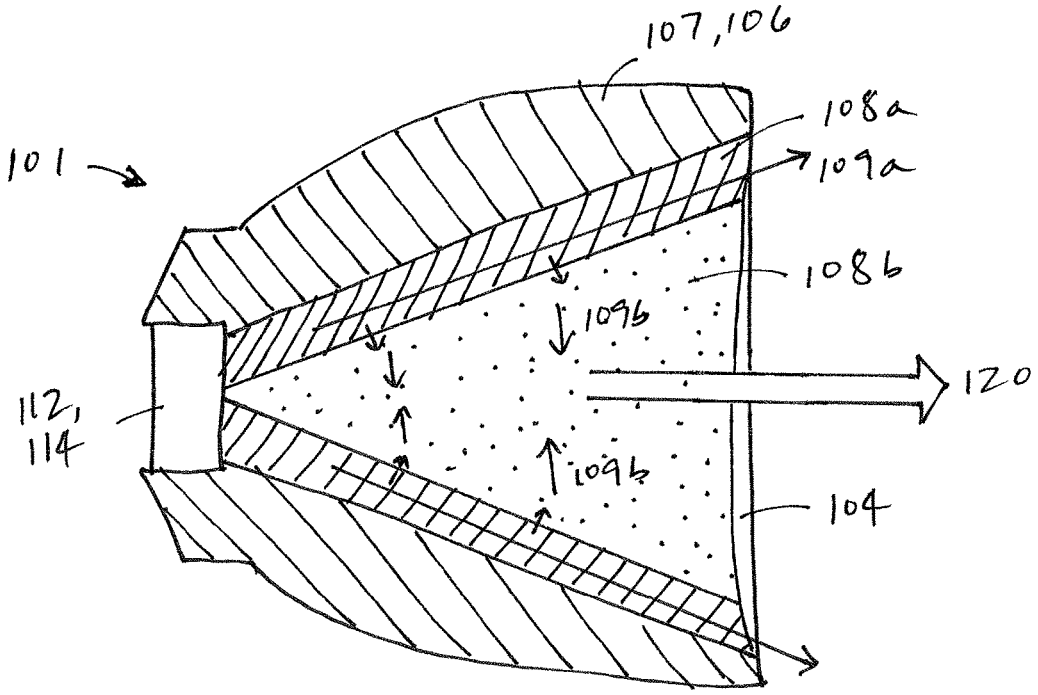
FIG. 15 is a cross-sectional view of another embodiment of an individual charge having colliding forces, where the walls of the casing are lined with explosive material and the chamber includes additional explosive material.
Figure 16:
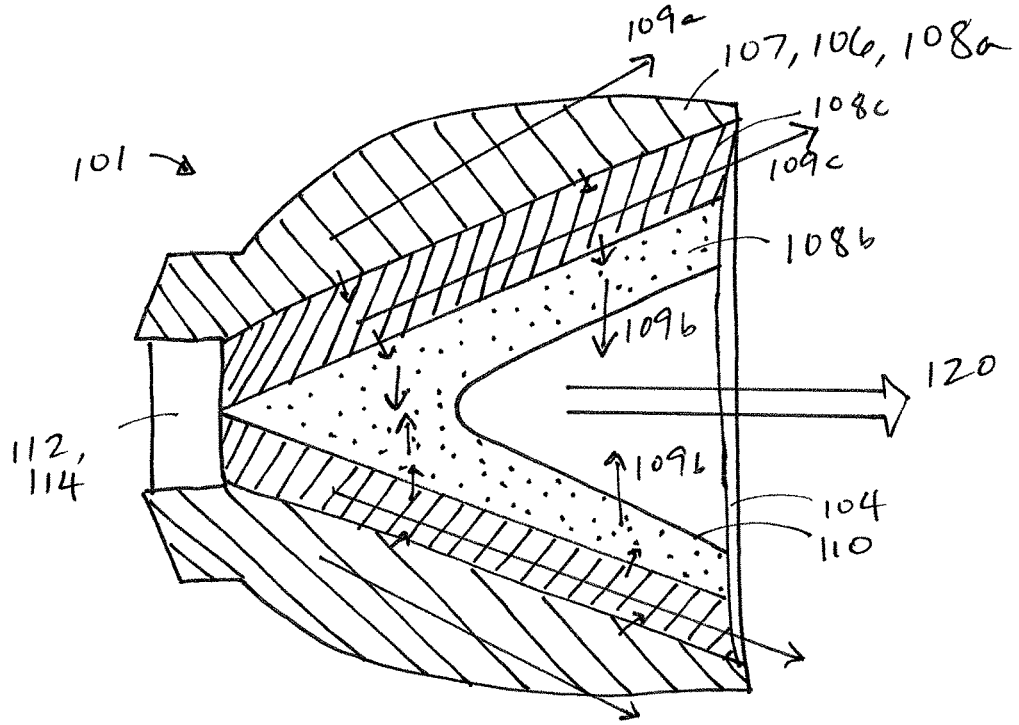
FIG. 16 is a cross-sectional view of another embodiment of an individual charge having colliding forces, where the walls of the casing include explosive material and are lined with a supplemental explosive material, and the chamber includes additional explosive material retained by a liner.
Figure 17:
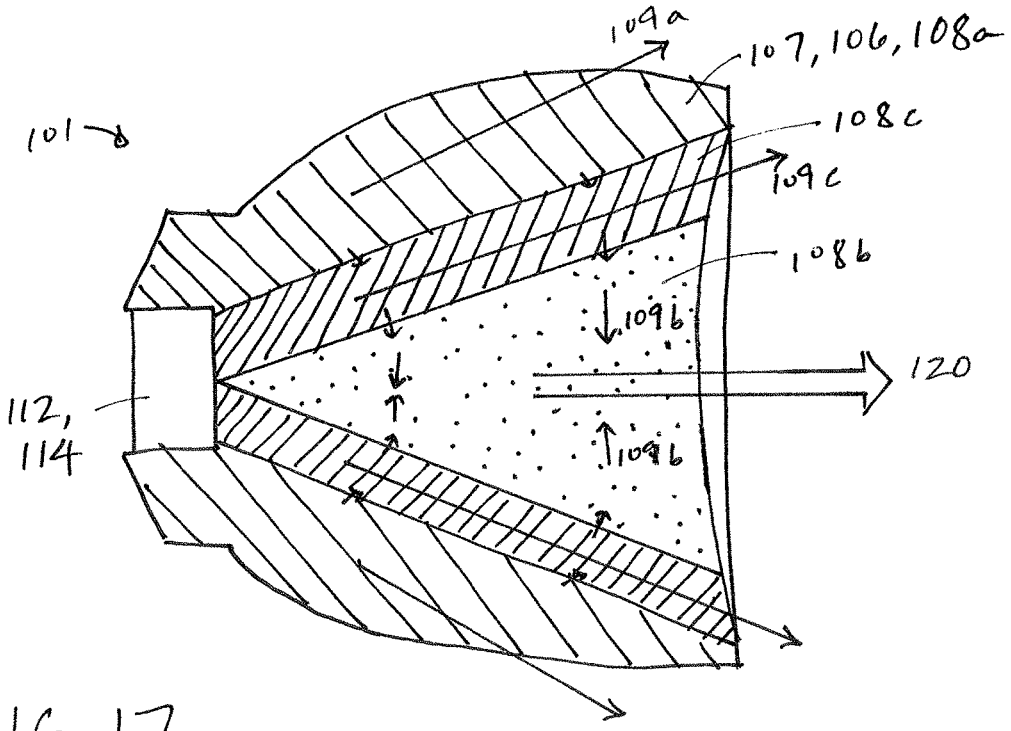
FIG. 17 is a cross-sectional view of another embodiment of an individual charge having colliding forces, where the walls of the casing include explosive material and are lined with a supplemental explosive material, and the chamber includes additional explosive material.
Figure 18A:
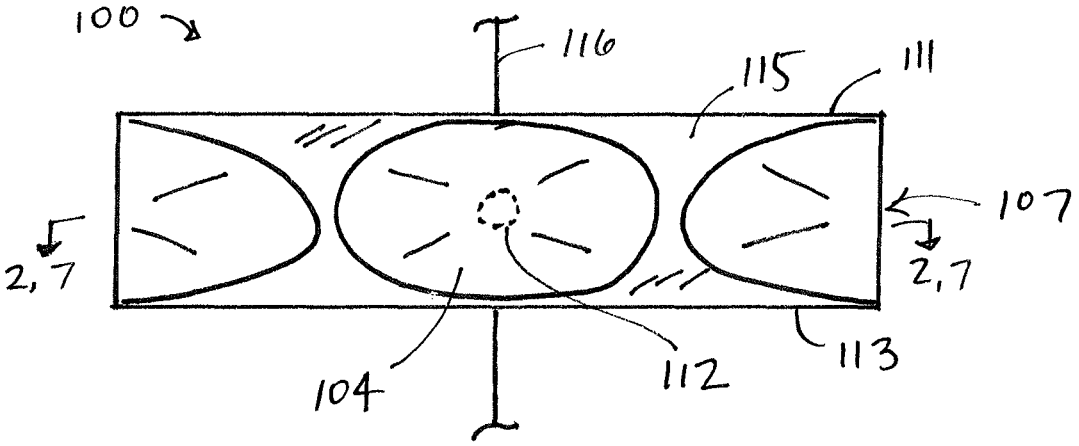
FIG. 18A is a side elevation of one embodiment of the multi-shot charge of the present invention, having a curved casing and oval openings.
Figure 18B:
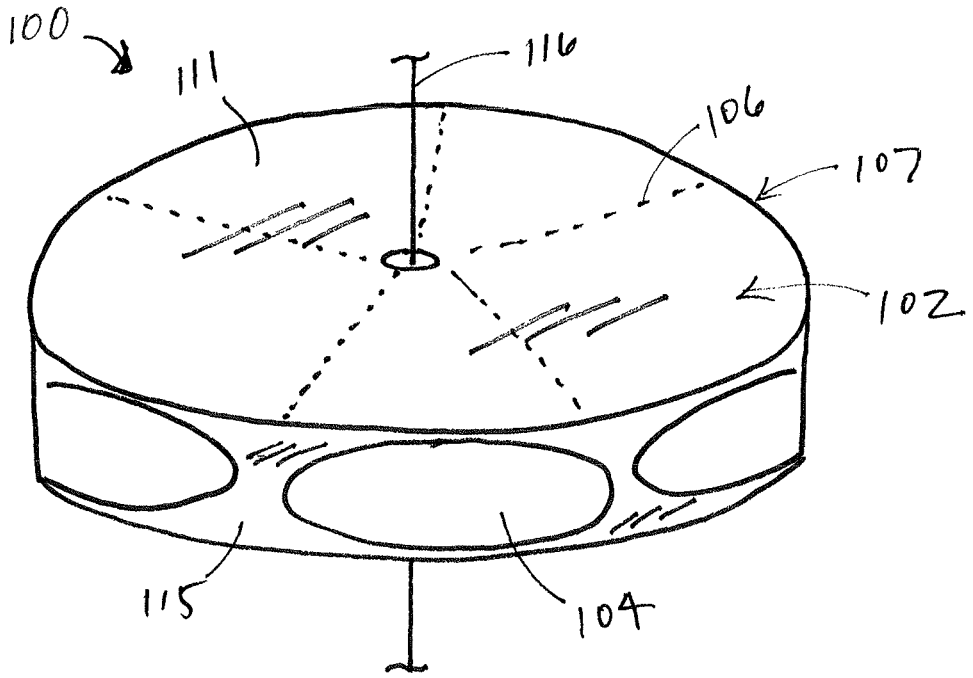
FIG. 18B is an isometric view of the multi-shot charge of FIG. 18A.
Figure 19A:
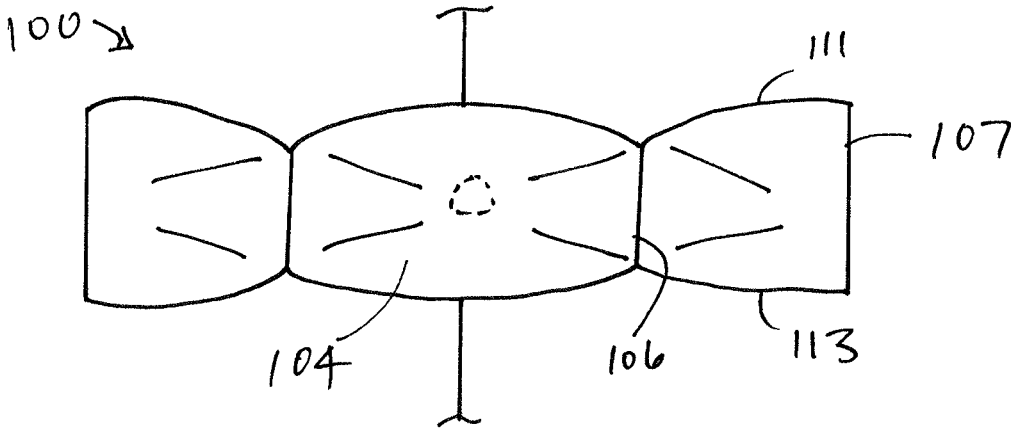
FIG. 19A is a side elevation of another embodiment of the multi-shot charge of the present invention, having a curved casing and oblong openings.
Figure 19B:
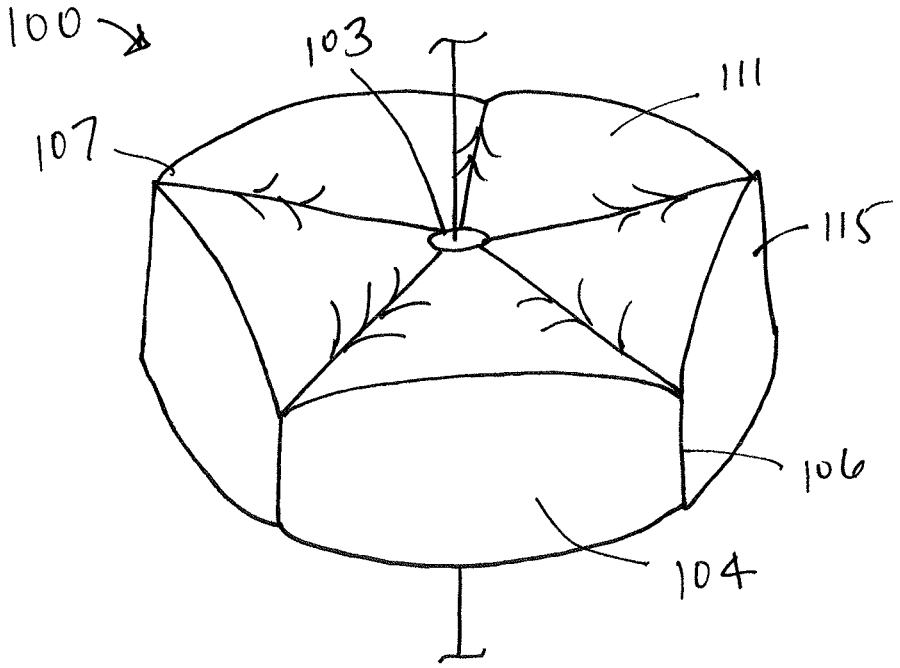
FIG. 19B is an isometric view of the multi-shot charge of FIG. 19A.
Figure 20A:
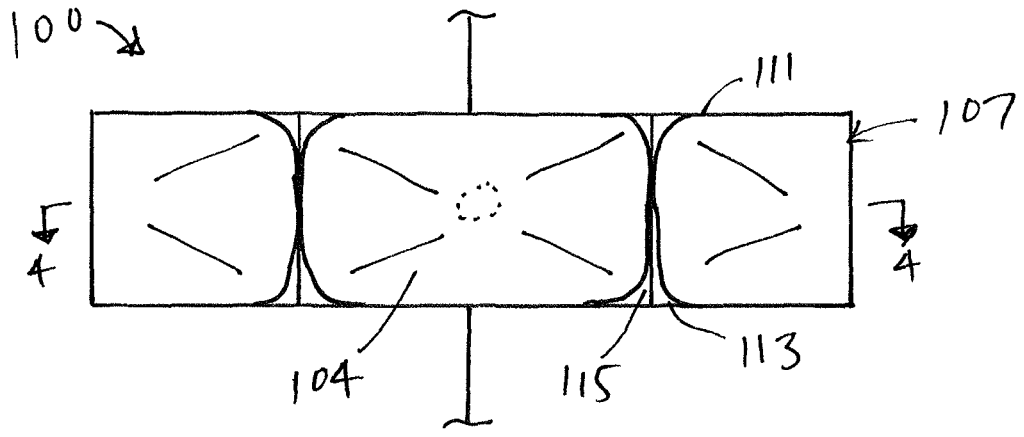
FIG. 20A is a side elevation of another embodiment of the multi-shot charge of the present invention, having a straight sided casing and oblong openings.
Figure 20B:
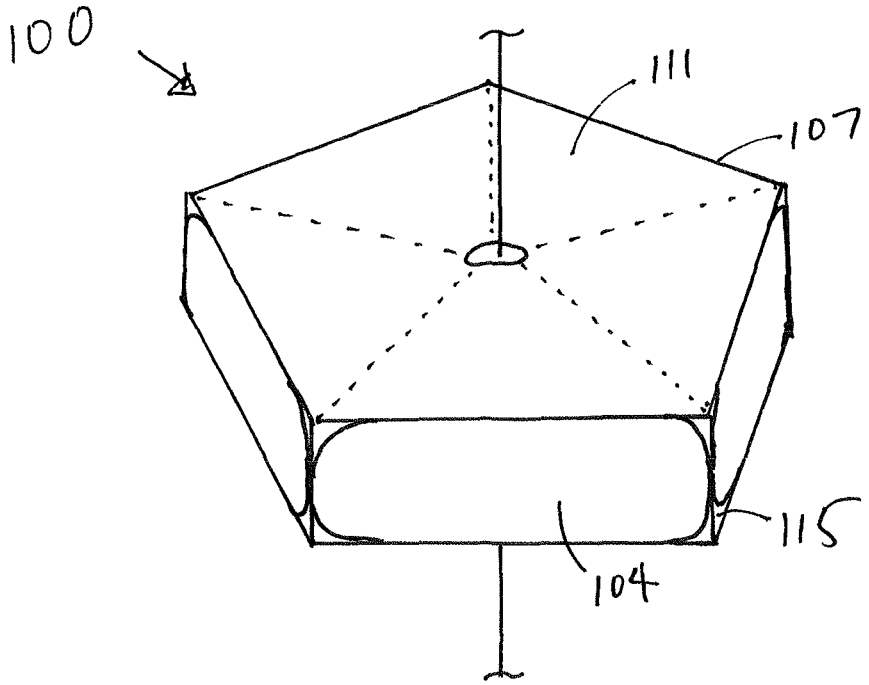
FIG. 20B is an isometric view of the multi-shot charge of FIG. 20A.
Figure 21A:
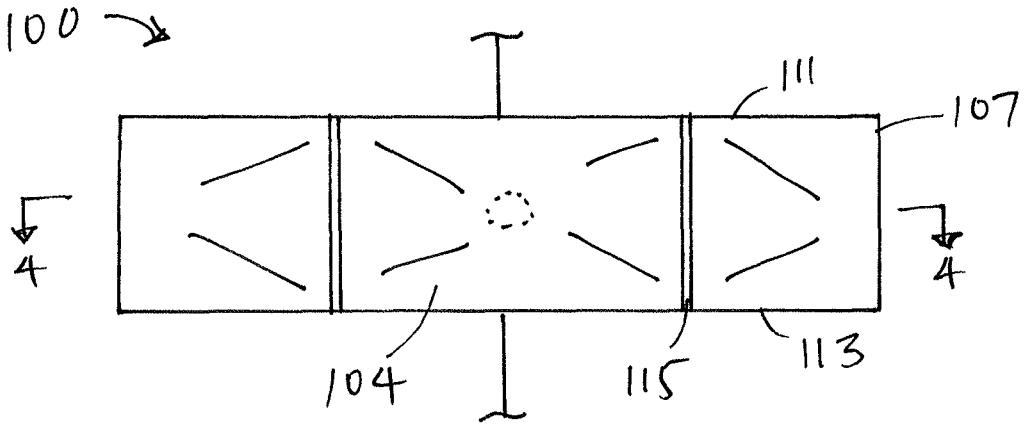
FIG. 21A is a side elevation of another embodiment of the multi-shot charge of the present invention, having a straight sided casing and rectangular openings.
Figure 21B:
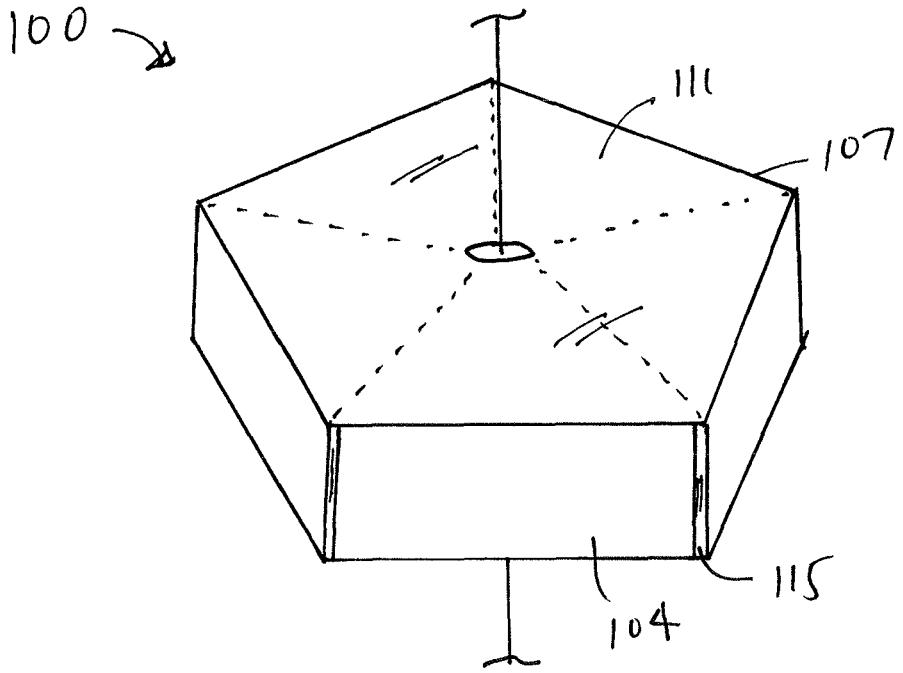
FIG. 21B is an isometric view of the multi-shot charge of FIG. 21A.
Figure 22A:
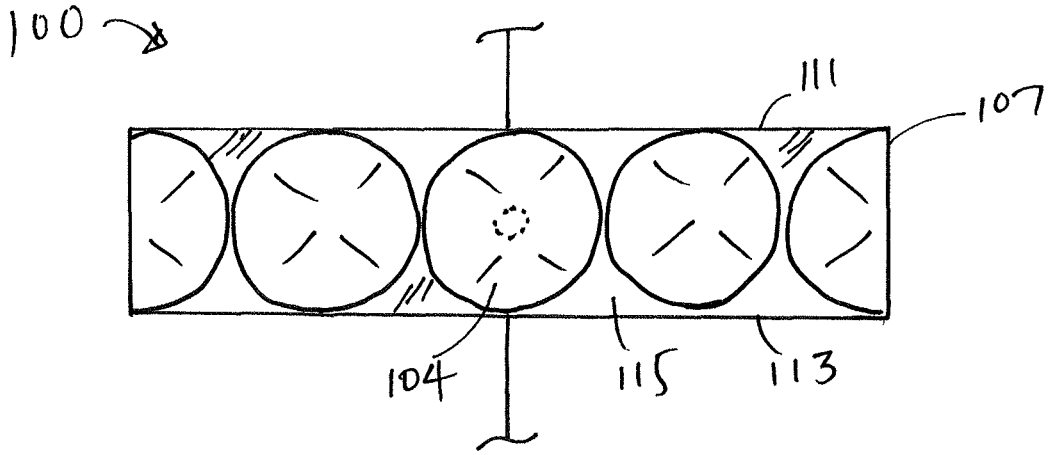
FIG. 22A is a side elevation of another embodiment of the multi-shot charge of the present invention, having a curved casing and circular openings.
Figure 22B:
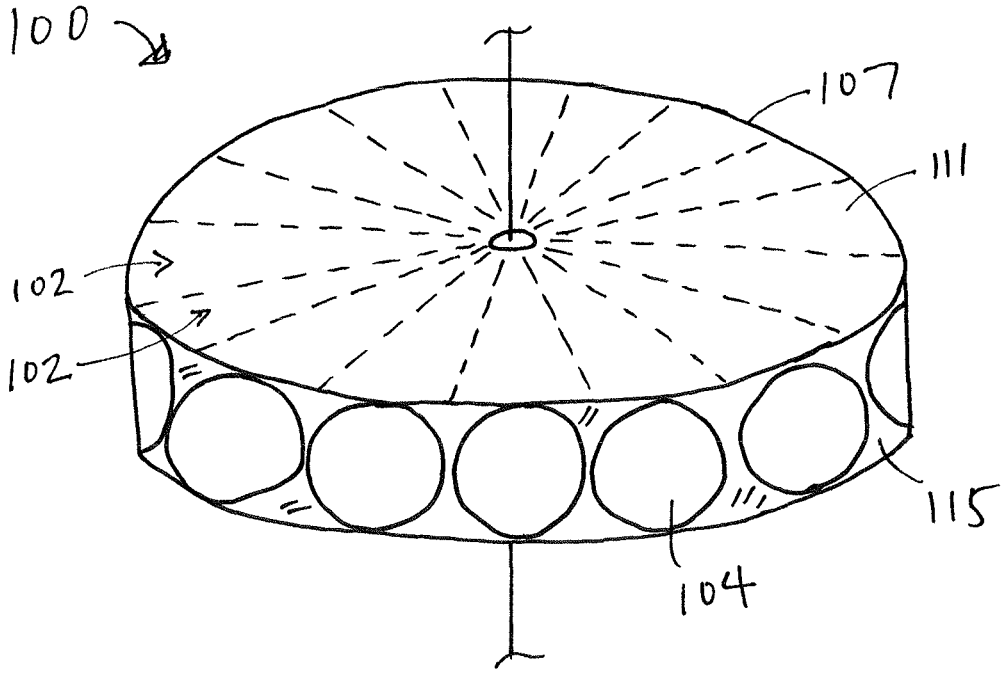
FIG. 22B is an isometric view of the multi-shot charge of FIG. 22A.
Figure 23A:
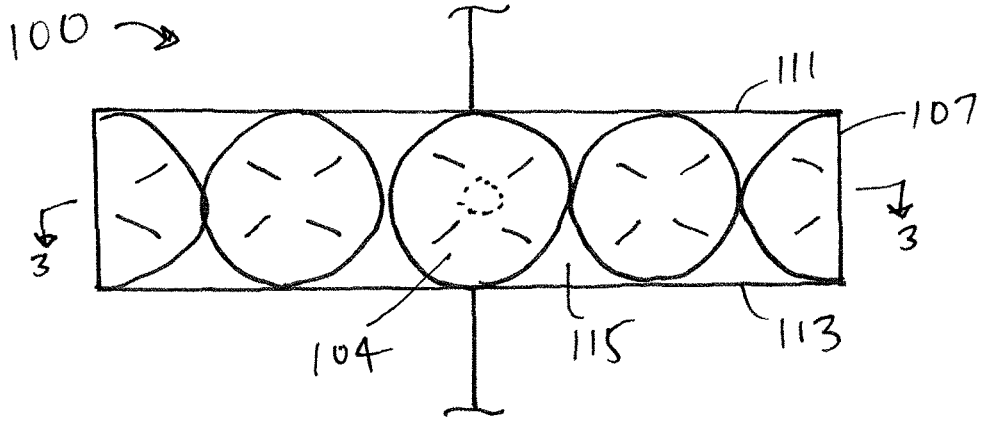
FIG. 23A is a side elevation of another embodiment of the multi-shot charge of the present invention, having a straight sided casing and circular openings.
Figure 23B:
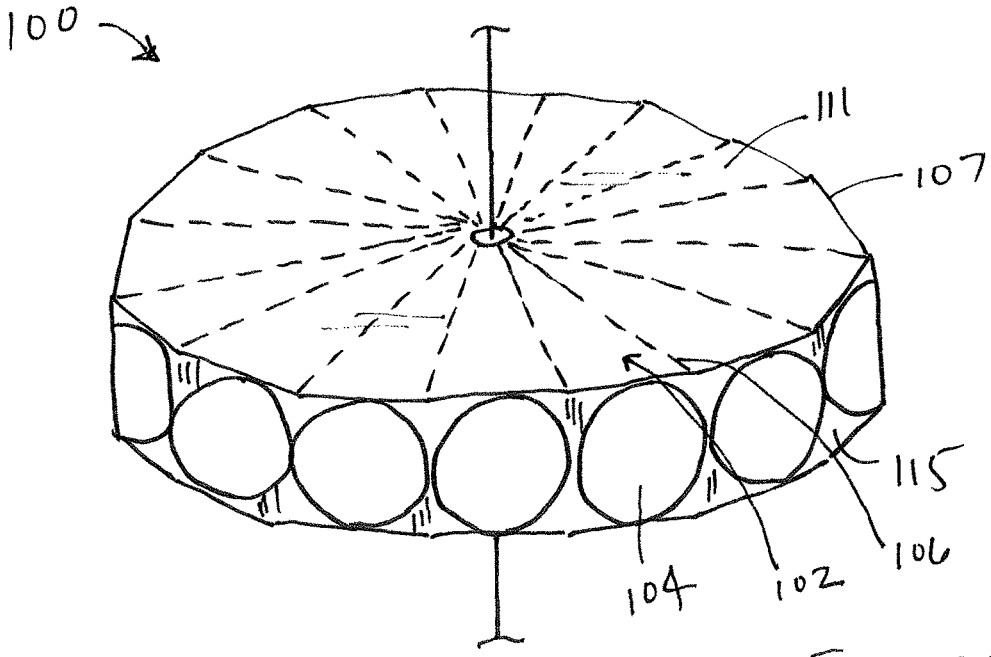
FIG. 23B is an isometric view of the multi-shot charge of FIG. 23A.
Figure 24A:
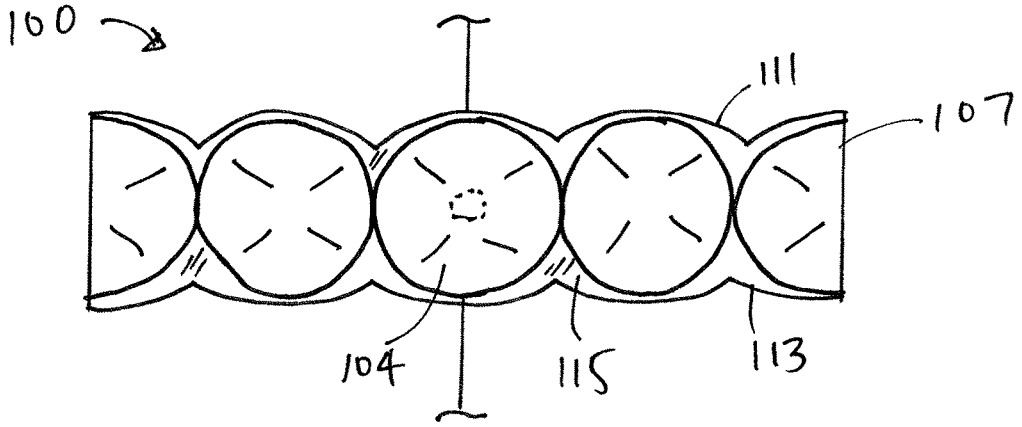
FIG. 24A is a side elevation of another embodiment of the multi-shot charge of the present invention, having a curved casing and circular openings.
Figure 24B:
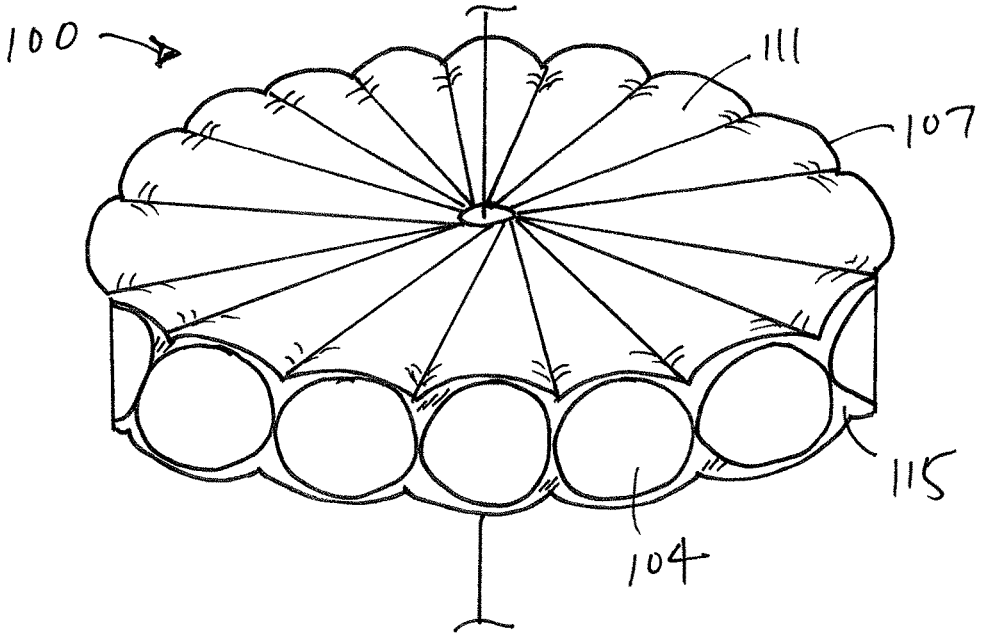
FIG. 24B is an isometric view of the multi-shot charge of FIG. 24A.

FIGS. 14 and 15 are similar to FIG. 7 for the multi-shot charge 100*c* where the wall(s) 106 are lined with or contacting a layer of first explosive material 108*a* and a second explosive material 108*b* is included in the chamber 102, but showing it in an individual charge 101. FIG. 14 shows the use of a liner 110 to retain the second explosive material 108*b*, whereas there is no liner 110 in FIG. 15. FIGS. 16 and 17 are similar to FIG. 9 for the multi-shot charge 100*d* where the wall(s) 106 include a first explosive material 108*a*, which are also lined with or contacting a layer of supplemental explosive material 108*c*, and a second explosive material 108*b* is included in the chamber 102. FIG. 16 shows the use of a liner 110, whereas FIG. 17 demonstrates a linerless embodiment. These are but a few examples to illustrate that the colliding forces 109 are not limited to multi-shot charges 100, but can be accomplished in standalone individual charges 101 as well.

Each multi-shot charge 100 is contained within a casing 107. The casing 107 may be of any suitable material typically used in perforating charges, such as but not limited to steel. As is evident throughout the Figures, the casing 107 may be shaped as a disc, puck, sphere, or other suitable geometrical shape accommodating a plurality of chambers 102 within a casing 107. FIGS. 18A-24B show various examples of different embodiments of the casing 107, where FIGS. 18A, 19A, 20A, 21A, 22A, 23A and 24A show side elevations of various examples of multi-shot charges 100, and FIGS. 18B, 19B, 20B, 21B, 22B, 23B and 24B show an isometric view of the corresponding multi-shot charge 100. For instance, the casing 107 may be generally circular in shape, having a flat top surface 111 and bottom surface 113, and a curved perimetric surface 115, as shown in FIGS.

18A-18B and 22A-22B. The top and bottom surfaces 111, 113 may be curved, however, such as to conform to the shape of the opening 104, as depicted in FIGS. 19A-19B and 24A-24B. In some embodiments, the top and bottom surfaces 111, 113 as well as the perimetric surface 115 are all straight or planar, such as in FIGS. 20A-20B, 21A-21B and 23A-23B. In still other embodiments, as referenced previously, the casing 107 may have a rectangular, square, irregular, or other shape, with the chambers 102 arranged so that the opening(s) 104 are on a perimetric surface 115.

The openings 104 of the casing 107 corresponding to separate chambers 102 therein may also have a variety of different shapes. For instance, the openings 104 may be oval, such as in FIGS. 18A-18B. In other embodiments, the openings 104 may be oblong or rounded, such as in FIGS. 19A-20B. In still other embodiments, the openings 104 may be rectangular, as in FIGS. 21A-21B. In further embodiments, the openings 104 may be circular, as in FIGS. 22A-24B. These are merely examples of opening 104 shapes, and should not be considered limiting in any way. Further, any combination of casing 107 shape and opening 104 shape is contemplated herein, such that circular openings 104 can be used with straight edged casings 107, as in FIGS. 23A-23B.

The openings 104 may have any shape, configuration, or dimensions as would permit the explosive material 108 and/or liner 110 to be inserted into the corresponding chamber 102, and for the perforating jet 120 to exit. In some embodiments, the opening 104 is maximized to encompass almost the entire perimetric surface 115 of the casing 107 for the corresponding chamber 102. For instance, the opening 104 may extend circumferentially along the perimetric surface 115 from one wall 106 to the next wall of the adjacent chamber 102, and may extend from the top surface 111 to the bottom surface 113 of the casing.

The multi-shot charge 100 may have any diameter or width as could be accommodated within a wellbore. For instance, in at least one embodiment, the multi-shot charge 100 has a larger diameter than height dimension, as measured from the top surface 111 to bottom surface 113. In at least one embodiment, the multi-shot charge 100 is sized to fit within a perforating gun 205, as described in more detail hereinafter.

Figure 25:
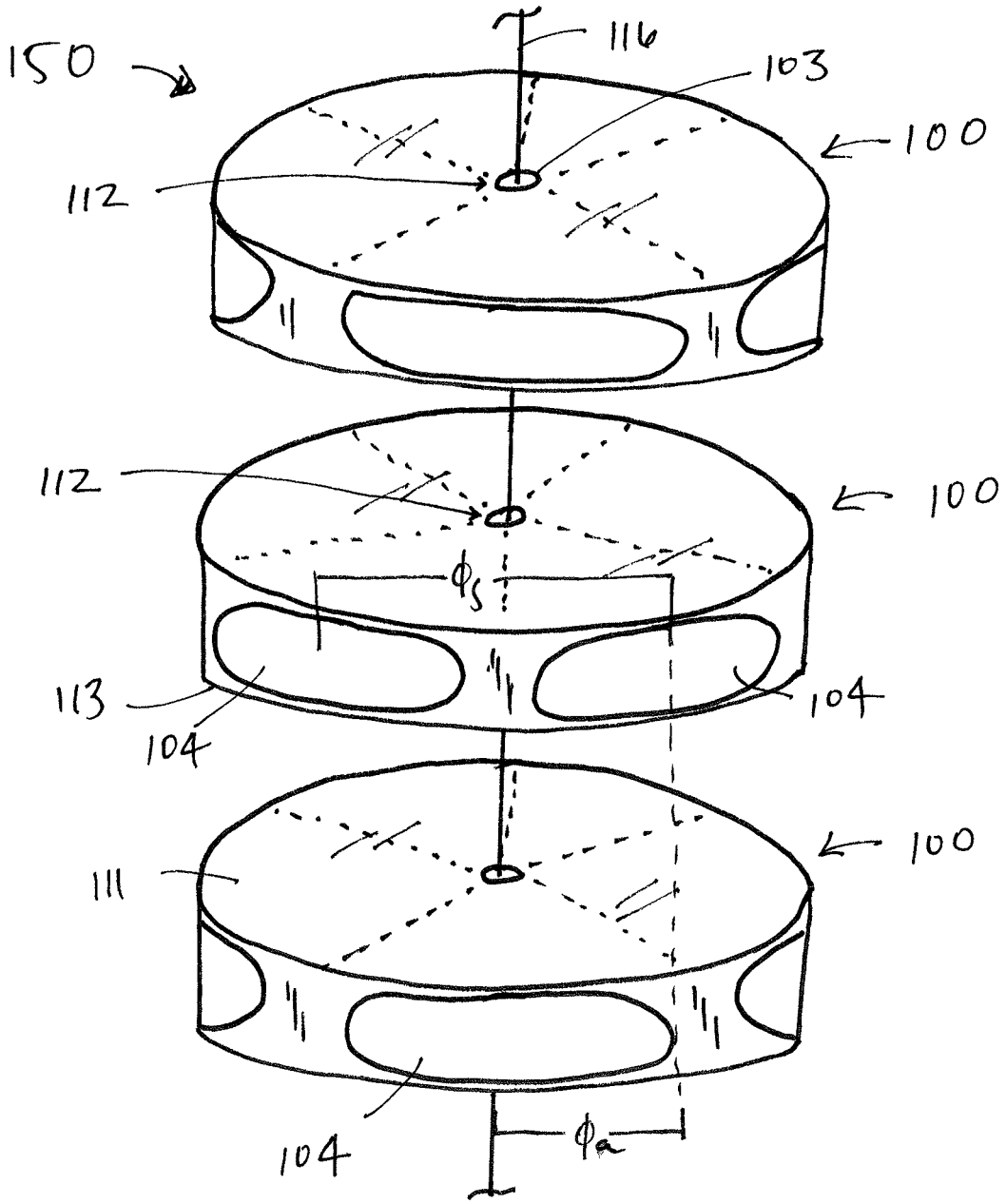
FIG. 25 is an isometric view of an array of multi-shot charges of the present invention.

In use, a single multi-shot charge 100 may be used to create perforation jet(s) 120 in surrounding strata, or multiple multi-shot charges 100 may be used together in an array 150 as seen in FIG. 25. Each of the multi-shot charges 100 within an array 150 may be the same, having the same number of chambers 102, arrangement or pattern of charged chambers, and same types and arrangements of explosive materials 108*a,b,c* therein. In other embodiments, however, different multi-shot charges 100 within the same array may have different numbers of chambers 102, different arrangements or patterns of charged chambers, and different types and arrangements of explosive materials 108*a,b,c*. Any combination of multi-shot charges 100 and configurations therein are contemplated in the present invention, depending on the desired perforation pattern.

Each multi-shot charge 100 includes a detonation assembly 112, preferably located at the center of the multi-shot charge 100, and which may be located within a channel 103 formed by at least one of the walls 106 and casing 107. When a plurality of multi-shot charges 100 are arranged in an array 150, the multi-shot charges 100 are interconnected to one another, such as through a detonation cord 116 or other linkage. The linkage may be physical, such as a denotation cord, rope, or other mechanical linkage. It is also contemplated that the linkage between multi-shot charges 100 within an array 150 may be intangible, such as through a wireless or Bluetooth network, radiofrequency identification (RFID) or near field communication (NFC) connections, and other intangible communication links that can be accessed and/or controlled by an appropriate device. The multi-shot charges 100 in the array 150 may be linked to provide detonation of each multi-shot charge 100.

Adjacent multi-shot charges 100 within an array 150 may be arranged to directly contact one another in some embodiments, such as the top surface 111 of one multi-shot charge 100 contacting the bottom surface 113 of the adjacent multi-shot charge 100. In other embodiments, the multi-shot charges 100 may be spaced apart from one another. FIG. 25 shows part of an array 150 where the multi-shot charges 100 are spaced apart, which may be a spaced apart example or an exploded view. Any distance of spacing between adjacent multi-shot charges 100 within an array 150 is contemplated, within the parameters of the situation where the array 150 is intended to be used. For example, the multi-shot charges 100 may be spaced microns, millimeters, centimeters, or meters apart from one another.

As is also demonstrated in FIG. 25, the multi-shot charges 100 may be arranged within the array 150 to create a preselected phasing of perforations when detonated. This can help alleviate the stresses on the well and strata surrounding the perforation tunnels. Phasing is commonly understood in the art, and as used herein refers to the distribution or offset of perforations around the array 150 and/or perforation gun 205. Since each multi-shot charge 100 includes a plurality of chambers 102, each chamber 102 can be said to be phased with respect to the other chambers 102 within the multi-shot charge 100. This may be referred to herein as "intra-shot phasing" or $\phi_s$. Phasing can also occur between the perforations made by different multi-shot charges 100 within an array 150. This may be referred to herein as "array phasing" or $\phi_a$. for the purposes of clarity. "Phasing" when used generally herein may refer equally to either intra-shot phasing or array phasing. Phasing may occur at intervals of 0°, 60°, 90°, 180°, 120° or at any angle within the range of 0° to 360°. For instance, FIG. 25 shows an intra-shot phase $\phi_s$ of 72°, and an array phasing $\phi_a$ of 36°. Phasing may also occur by only charging certain chambers 102 within the multi-shot charges 100, so that the phasing $\phi$ occurs only between the charged chambers 102. Additionally, there may be multiple intra-shot phasings and array phasings in embodiments where the chambers 102 are not identical. Differently sized chambers 102 having walls 106 at smaller or larger angles will result in different phasing between the chambers 102 of different sizes.

Figure 26:
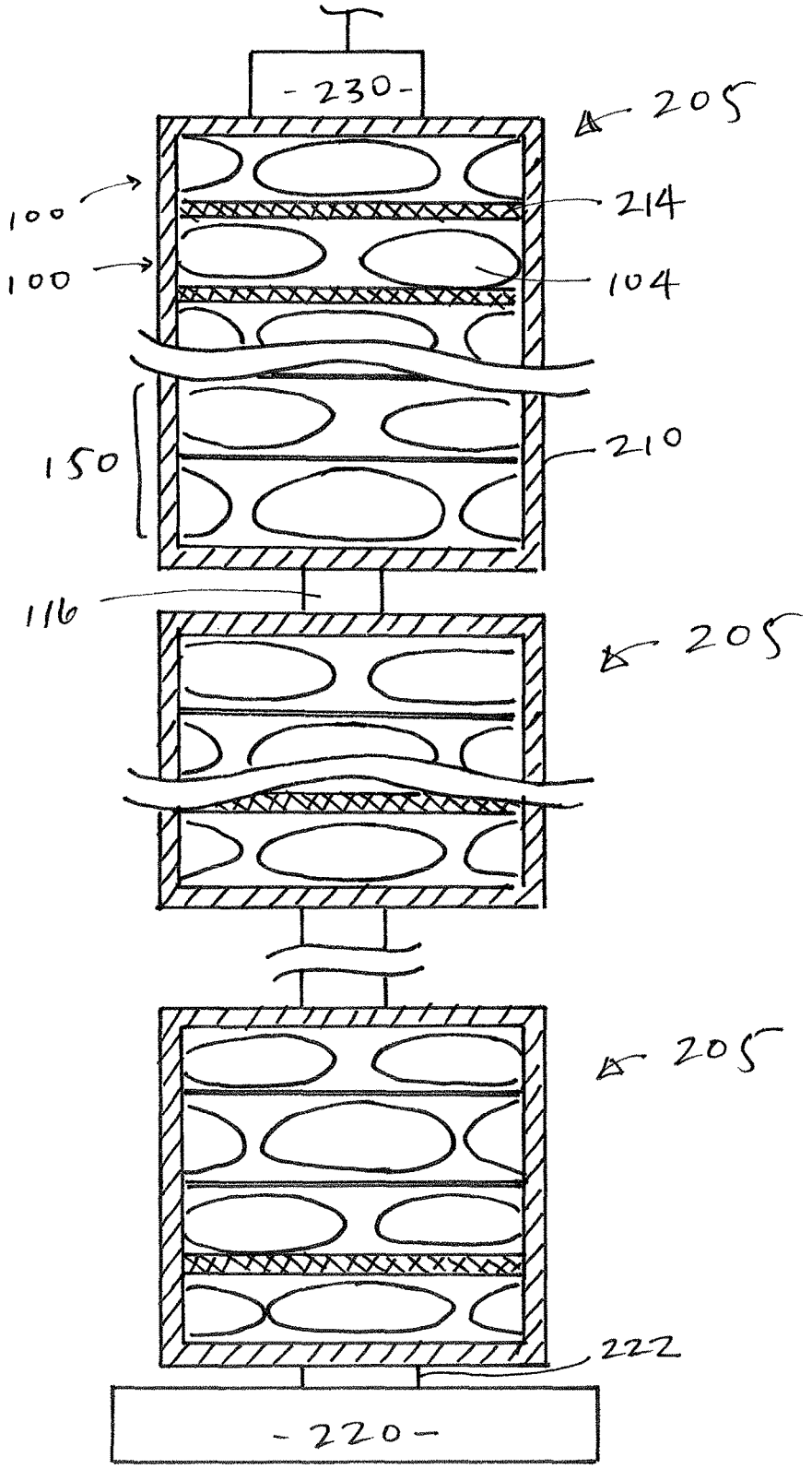
FIG. 26 is a partial cross-section of multiple perforating guns each having a plurality of multi-shot charges.

Turning now to FIG. 26, the present invention is also directed to at least one perforating gun 205, each of which includes at least one multi-shot charge 100. The perforating gun 205 includes a housing 210 and a hollow interior 212 in which multi-shot charge(s) 100 are positioned. The multi-shot charges 100 have a diameter and circumference that fit within the interior 212 of the perforating gun housing 210. For instance, perforating guns 205 are typically between 2.5-9 inches in diameter and 12-360 inches in length. Accordingly, the diameters of the multi-shot charges 100 may be in the range of 1-8.5 inches. However, the multi-shot charge 100 of the present invention permit reduced size perforating guns 205 without sacrificing power, such as down to 1 inch. Moreover, because of the design of the multi-shot charge 100, the perforating gun 205 can hold an increased number of charges compared to current perforation guns. Common perforation guns used to date can hold 6 to 18 shaped charges per gun over 1-3 feet of perforation gun length respectively. The perforating gun 205 of the present invention, on the other hand over the same 3 feet of linear length, can hold 1 to 36 multi-shot charges 100, each of which may include 2 to 12 chambers 102 corresponding to a charge. Thus, the present design significantly increases the number of perforations possible within a smaller footprint.

The multi-shot charges 100 and arrays 150 can be used with any type of perforating gun 205, including but not limited to hollow carrier, capsule, slip-on, scalloped, tubing puncher, expanded range and fractal stimulation systems. In at least one embodiment, the multi-shot charges 100 and array 150 can be used in a hollow carrier perforating gun 205 where the gun is enclosed in a pressure-tight tube that protects the multi-shot charges 100 and gun components from penetration by the well fluid and mud present in the wellbore from the drilling/completion and well preparation process.

As illustrated in FIG. 26, a plug 220 may be connected to the perforating gun 205 through a plug setting tool 222 to isolate or restrict flow of fluids and mud in the wellbore to the locations down-hole or uphole of the location of where the plug 220 is set in the well. Accordingly, the plug 220 is located on the leading side of the perforating gun 205, which is the side that is closer to the toe of the wellbore. As is common practice, the plug 220 may be substantially the same diameter, but slightly smaller than the interior diameter of the wellbore tubular, to permit movement of the plug 220 and connected perforating gun 205 through the wellbore casing while also restricting fluid flow. The perforating gun 205 typically has a slightly smaller diameter than the plug 220. For example, if the interior diameter (I.D.) of the wellbore casing is 4.77 inches, the plug 220 may have an outer diameter (O.D.) of 4.3 inches, and the perforating gun 205 may have an O.D. of 3.125 inches. This is but one example, and is not intended to be limiting in any way.

As shown in FIG. 26, the perforating gun 205 may also include an electronics component 230, such as opposite from the plug 220. In at least one embodiment, as shown in FIG. 26, the plug 220 is located on the down-well or leading side of the perforating gun 205, and the electronics component 230 is located on the up-well or lagging side of the perforating gun 205. The electronics component 230 includes the necessary memory, processor, circuitry, logic controls, and other electrical elements needed to operate the perforating gun and/or monitor its position, depth, location, performance, surrounding conditions in the wellbore and other conditions such as temperature and pressure. The electronics component 230 may be retained within a dedicated housing or casing, although in some embodiments the electronics component 230 may be located within the housing 210 of the perforating gun 205. The electronics component 230 is connected to the perforating gun 205, such as by being secured to the exterior or interior of the perforating gun housing 210, or may be remotely connected to the perforating gun 205. The electronic components found within 230 may also be present on the surface of the wellbore, connected to 205 via a wire or other mechanical connection and not lowered into the wellbore.

The perforating gun 205 includes at least one multi-shot charge 100, and may include an array(s) 150 of multi-shot charges 100. Isolation spacers 214 may be used to separate individual multi-shot charges 100 or arrays 150, as depicted in FIG. 26, to control when the charges are detonated. For instance, all the multi-shot charges 100 between isolation spacers 214 may be detonated simultaneously. Multi-shot charges 100 positioned on the other side of the isolation spacer 214 are insulated from detonation, such as from the pressure and/or temperature associated with detonation. Accordingly, multi-shot charges 100 separated by isolation spacers 214 can be selectively or automatically detonated at different times. Isolation spacers 214 may be made of a thermoplastic or pressure-resistant material such as a metal or composite plug in conjunction with o-rings or snaprings. In some embodiments, isolation spacers 214 are not used, and all the multi-shot charges 100 within the perforating gun 205 are detonated at the same time.

Figure 27:
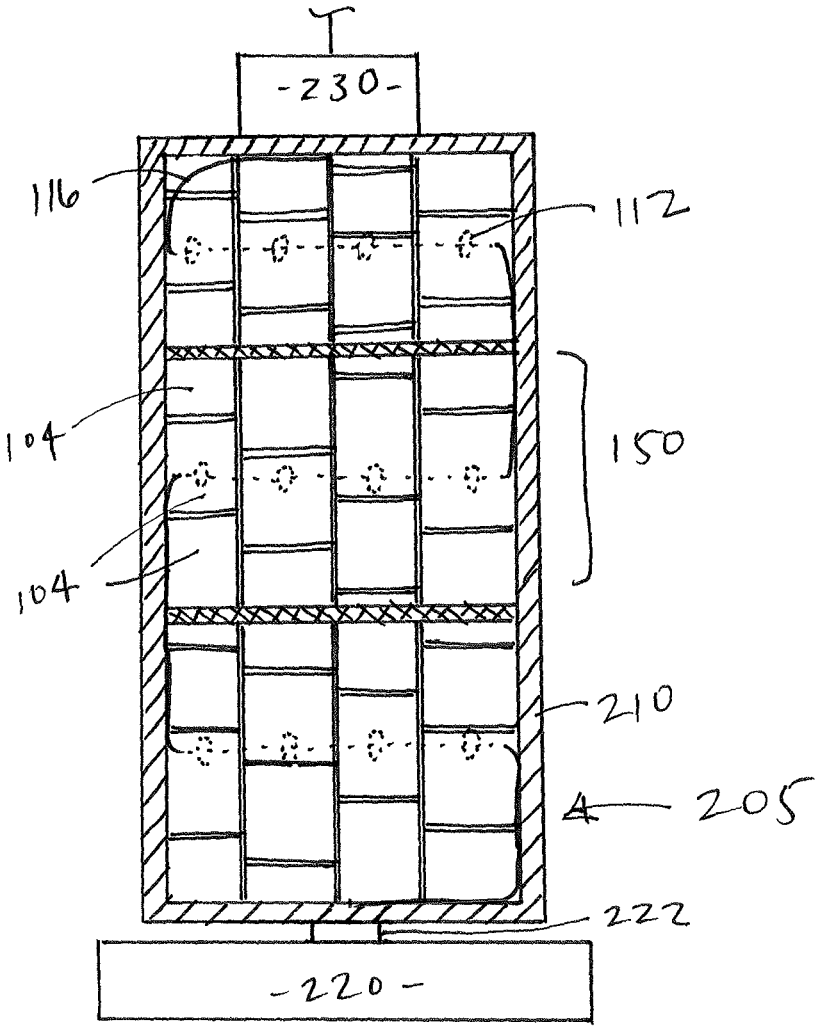
FIG. 27 is a partial cross-section of a perforating gun including a plurality of multi-shot charges arranged in horizontal orientation.
Figure 28:
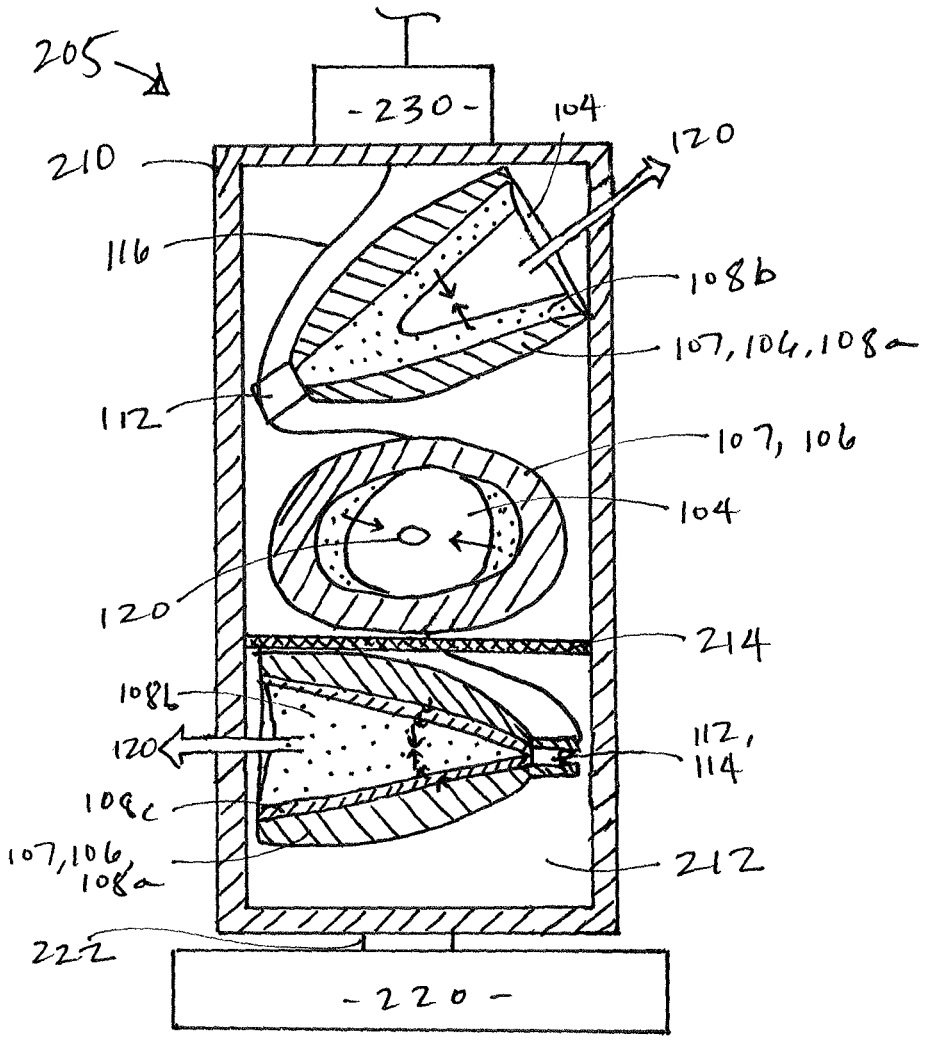
FIG. 28 is a partial cross-section of a perforating gun including a plurality of individual charges having explosive material arranged to produce colliding forces.

The multi-shot charges 100 and/or arrays 150 can be arranged in any orientation within the perforating gun 205 as the respective sizes and shapes will accommodate, and further as desired to achieve the intended perforating pattern. For instance, the multi-shot charges 100 can be arranged vertically within the perforating gun 205, as seen in FIG. 26, such that the multi-shot charges 100 are coaxial with the perforating gun 205. In other embodiments, as in FIG. 27, the diameters of the multi-shot charges 100 may be smaller, allowing them to be arranged horizontally within the perforating gun 205, such that the detonation cord 116 linking the multi-shot charges 100 together runs transverse to the axis of the perforating gun 205. Isolation spacers 214 may be used to separate horizontal arrays 150, and the detonation cord 116 may run from one end of one array 150 to the nearest end of the next adjacent array 150, such as in a weaving or snaking manner as depicted in FIG. 27. These are but a few examples, and it should be appreciated that any orientation and configuration of multi-shot charges 100 within an array 150 or perforating gun 205 may be used and are contemplated herein. As also depicted in FIG. 26, multiple perforating guns 205, each having their own composition of multi-shot charges 100, may be strung together successively along a detonation cord 116 or other linkage. FIG. 28 shows an example of a perforating gun 205 that includes an array of various individual charges 101 having colliding forces 109 as described above, rather than multi-shot charges 100. The charges 101 are linked together by a detonation cord 116, but any linkage or connection is contemplated. It should be appreciated that any arrangement and distribution of individual charges 101 having colliding forces 109 within the perforating gun 205 is possible and contemplated herein.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. A perforating charge, comprising:

at least one chamber having a closed end and an open end, and defined by at least one wall forming an outer perimetric surface and an interior space;

a first explosive material being one of: (i) within said at least one wall, and (ii) located along a substantial portion of said at least one wall within said at least one chamber, said first explosive material configured to generate first explosive forces radiating from said at least one wall toward said interior space upon detonation:

a second explosive material located within said interior space and in direct contact with a substantial portion of said first explosive material, said second explosive material exposed to ambient atmosphere prior to detonation and further configured to generate second explosive forces radiating toward said interior space upon detonation: and upon detonation, said first and second explosive forces subsequently colliding within said interior space of said chamber to form a perforating jet directed in an outward direction through said open end of said chamber.

2. The perforating charge as recited in claim 1, wherein said perforating jet is proportional to at least one of: (i) an angle formed in said closed end of said chamber, (ii) a magnitude of said first and second explosive forces collectively, (iii) a magnitude of collision of said first and second explosive forces, (iv) an angle of said first and second explosive forces upon collision.

3. The perforating charge as recited in claim 1, wherein said perforating jet includes a length and a width, said length of said perforating jet being inversely proportional to said width.

4. The perforating charge as recited in claim 1, wherein said at least one wall is at least one of the following: (i) formed of said first explosive material, and (ii) retains said first explosive material.

5. The perforating charge as recited in claim 1, further comprising a supplemental explosive material configured to produce supplemental explosive forces upon detonation, said supplemental explosive material disposed between said first and second explosive materials.

6. The perforating charge as recited in claim 1, wherein said second explosive material substantially fills said interior space of said at least one chamber.

7. The perforating charge as recited in claim 1, wherein said at least one wall forms a casing of an individual charge.

8. The perforating charge as recited in claim 1, wherein said at least one wall is common wall separating and at least partially defining adjacent ones of a plurality of chambers within a shared casing of a multi-shot charge.

9. The perforating charge as recited in claim 1, wherein said first explosive material is configured to detonate said second explosive material and said first explosive forces affect the direction of said second explosive forces.

10. The perforating charge as recited in claim 9, wherein said perforating jet includes a width and a length, and is subject to at least one of: (i) said width of said perforating jet decreases as the difference between said first and second detonation rates increases; (ii) said length of said perforating jet increases as said width of said perforating jet decreases; (iii) said length of said perforating jet increases as the magnitude of at least one of said first and second explosive forces increases.

11. The perforating charge as recited in claim 1, wherein said first explosive material is configured to detonate at a first detonation rate, said second explosive material is configured to detonate at a second detonation rate, and said first and second detonation rates are selected from the group consisting of; (i) said first detonation rate is greater than said second detonation rate, (ii) said first detonation rate is less than said second detonation rate, and (iii) said first detonation rate is equal to said second detonation rate.

12. The perforating charge as recited in claim 1, wherein said second explosive material is located closer to the center of said interior space than first explosive material.

13. The perforating charge as recited in claim 12, further comprising a supplemental explosive material configured to detonate at a supplemental detonation rate and configured to provide supplemental explosive forces upon detonation, said supplemental explosive forces affecting the direction of said second explosive forces.

14. The perforating charge as recited in claim 13, wherein said second explosive forces collide at a collision angle within said interior space, and said supplemental explosive forces change said collision angle of said second explosive forces.

15. The perforating charge as recited in claim 13, wherein said supplemental detonation rate is at least one of: (i) less than said first detonation rate, (ii) greater than said first detonation rate, (iii) equal to said first detonation rate, (iv) less than said second detonation rate, (v) greater than said second detonation rate, and (vi) equal to said second detonation rate.

16. An array comprising a plurality of interconnected perforating charges as recited in claim 1.

17. The array as recited in claim 16, wherein at least one of said perforating charges is contacting an adjacent one of said perforating charges.

18. The array as recited in claim 16, wherein at least one of said perforating charges is spaced apart from an adjacent one of said perforating charges.

19. A perforating gun comprising a housing, a gun interior, and at least one perforating charge as recited in claim 1 within said gun interior.

20. The perforating gun as recited in claim 19, further comprising up to 200 of said perforating charges.

21. The perforating gun as recited in claim 19, further comprising an isolation spacer between different ones of said perforating charges and insulating said perforating charges from at least one of pressure and temperature.

* * * * *